US010245836B2

(12) United States Patent
Araki et al.

(10) Patent No.: US 10,245,836 B2
(45) Date of Patent: Apr. 2, 2019

(54) HEAD CLEANING MECHANISM AND INKJET RECORDING APPARATUS INCLUDING THE SAME

(71) Applicant: KYOCERA Document Solutions Inc., Osaka (JP)

(72) Inventors: Takuma Araki, Osaka (JP); Kenichi Satake, Osaka (JP); Yasutaka Inui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/908,275

(22) Filed: Feb. 28, 2018

(65) Prior Publication Data

US 2018/0264824 A1 Sep. 20, 2018

(30) Foreign Application Priority Data

Mar. 14, 2017 (JP) ..... 2017-048263
Mar. 16, 2017 (JP) ..... 2017-050940

(51) Int. Cl.
*B41J 2/165* (2006.01)

(52) U.S. Cl.
CPC ..... *B41J 2/16538* (2013.01); *B41J 2/16508* (2013.01); *B41J 2/16511* (2013.01); *B41J 2/16544* (2013.01); *B41J 2/16552* (2013.01); *B41J 2/16585* (2013.01); *B41J 2002/16502* (2013.01); *B41J 2002/16558* (2013.01)

(58) Field of Classification Search
CPC ..... B41J 2/16538; B41J 2/16508; B41J 2/16552; B41J 2/16544; B41J 2/16511; B41J 2/16585; B41J 2002/16558; B41J 2002/16502
See application file for complete search history.

(56) References Cited

U.S. PATENT DOCUMENTS

2004/0036735 A1* 2/2004 Garbacz ..... B41J 2/16552 347/22
2009/0189945 A1* 7/2009 Sekiyama ..... B41J 2/16547 347/33

FOREIGN PATENT DOCUMENTS

JP 2007-83496 A 4/2007
JP 2016124111 A * 7/2016

* cited by examiner

*Primary Examiner* — Sharon A. Polk
(74) *Attorney, Agent, or Firm* — Stein IP, LLC

(57) ABSTRACT

A head cleaning mechanism includes a recording head and a wiper. The recording head has an ink ejection surface in which ink ejection ports are opened. The wiper wipes the ink ejection surface. The recording head has a cleaning liquid supply ports disposed on an upstream side of the ink ejection port in a wiping direction, and an inclined surface inclined downward toward a downstream side in the wiping direction, a tip of the wiper being in pressure contact with the inclined surface in the wiping operation. The inclined surface has a pressure contact start position at which the wiper starts the pressure contact in the wiping operation, and a water repellent region formed at least from the pressure contact start position to a position on an upstream side of the cleaning liquid supply port in the wiping direction.

20 Claims, 18 Drawing Sheets

HEAD CLEANING MECHANISM AND INKJET RECORDING APPARATUS INCLUDING THE SAME

INCORPORATION BY REFERENCE

This application is based upon and claims the benefit of priority from the corresponding Japanese Patent Applications No. 2017-048263 filed Mar. 14, 2017, and No. 2017-050940 filed Mar. 16, 2017, the entire contents of which are hereby incorporated by reference.

BACKGROUND

The present disclosure relates to a head cleaning mechanism including a recording head having an ink ejection port for ejecting ink to a recording medium such as a paper sheet, and to an inkjet recording apparatus including the head cleaning mechanism.

The inkjet recording apparatus can form a high definition images, and it is widely used as a recording apparatus such as a facsimile, a copier, or a printer.

In the inkjet recording apparatus, micro ink droplets (hereinafter referred to as mist) ejected together with ink droplets for recording an image and rebound mist generated when the ink droplets are adhered to the recording medium may be adhered and hardened to the ink ejection surface of the recording head. As the mist on the ink ejection surface is gradually increased and overlaps the ink ejection port, deterioration of ink ejection straightness (bending flying), non-ejection, or the like may occur, and printing performance of the recording head may be deteriorated.

Therefore, in order to clean the ink ejection surface of the recording head, there is known an inkjet recording apparatus in which a plurality of cleaning liquid supply ports are disposed in a part outside the ink ejection region in which a plurality of ink ejection ports are formed (a part on an upstream side in a wiping direction of a wiper) in the ink ejection surface. In this inkjet recording apparatus, after supplying cleaning liquid from the cleaning liquid supply port, the wiper is moved along the ink ejection surface from outside of the cleaning liquid supply port, so that the wiper can wipe the ink ejection surface while holding the cleaning liquid. In this way, a recording head recovery process can be performed.

SUMMARY

A head cleaning mechanism of a first aspect of the present disclosure includes a recording head and a wiper. The recording head has an ink ejection surface in which a plurality of ink ejection ports are opened to eject ink onto the recording medium. The wiper wipes the ink ejection surface in a predetermined direction. The recording head includes a plurality of cleaning liquid supply ports disposed on an upstream side of the ink ejection port in a wiping direction in which the wiper wipes the ink ejection surface, so as to supply cleaning liquid, and an inclined surface connected to a supply port formation surface in which the cleaning liquid supply ports are formed, on the upstream side in the wiping direction, the inclined surface being inclined downward toward a downstream side in the wiping direction, a tip of the wiper being in pressure contact with the inclined surface in the wiping operation. The inclined surface has a pressure contact start position at which the wiper starts the pressure contact in the wiping operation, and a water repellent region formed at least from the pressure contact start position to a position on an upstream side of the cleaning liquid supply port in the wiping direction to have a contact angle with water of 90° or more.

A head cleaning mechanism of a second aspect of the present disclosure includes a recording head and a wiper. The recording head has an ink ejection surface provided with an ink ejection region in which a plurality of ink ejection ports are opened to eject ink onto the recording medium. The wiper wipes the ink ejection surface in a predetermined direction. The recording head includes an inclined surface disposed on an upstream side of the ink ejection surface in a wiping direction in which the wiper wipes the ink ejection surface, the inclined surface being inclined downward toward a downstream side in the wiping direction, a tip of the wiper being in pressure contact with the inclined surface in the wiping operation. The inclined surface includes a plurality of cleaning liquid supply ports for supplying cleaning liquid disposed on the upstream side in the wiping direction of the pressure contact start position at which the wiper starts the pressure contact in the wiping operation, and a water repellent region formed from a position on the upstream side of the pressure contact start position in the wiping direction to a position on the downstream side, so as to have a contact angle with water of 90° or more.

Other objects of the present disclosure and specific advantages obtained by the present disclosure will become more apparent from the description of embodiments given below.

DETAILED DESCRIPTION

Hereinafter, embodiments of the present disclosure are described with reference to the drawings.

First Embodiment

Figure 1:
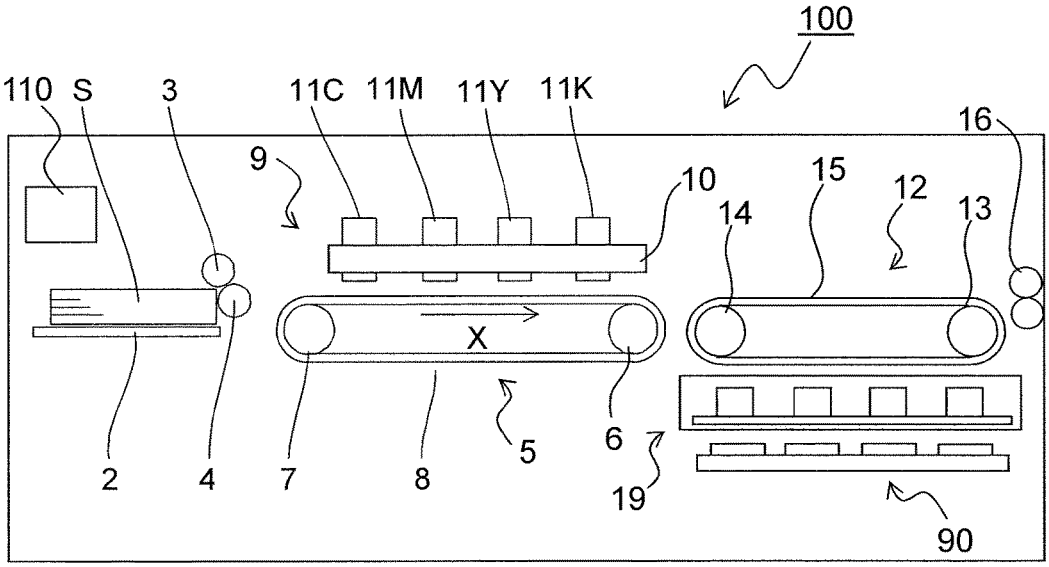
FIG. 1 is a diagram showing a structure of an inkjet recording apparatus including a recording head of a first embodiment of the present disclosure.

As shown in FIG. 1, a sheet feed tray 2 for storing paper sheets S (recording media) is disposed in a left side part of an inkjet recording apparatus 100 of a first embodiment of the present disclosure, and one end part of this sheet feed tray 2 is provided with a sheet feed roller 3 for feeding and conveying stored paper sheets S to a first conveying unit 5 described later one by one from the top paper sheet S, and a driven roller 4 that is driven to rotate in pressure contact with the sheet feed roller 3.

The first conveying unit 5 and a recording portion 9 are disposed on a downstream side (the right side in FIG. 1) of the sheet feed roller 3 and the driven roller 4 in a sheet conveying direction (arrow X direction). The first conveying unit 5 has a structure including a first drive roller 6, a first driven roller 7, and a first conveyor belt 8 stretched between the first drive roller 6 and the first driven roller 7. The first drive roller 6 is driven to rotate in a clockwise direction by a control signal from a control unit 110 that controls the entire inkjet recording apparatus 100, and hence the paper sheet S held on the first conveyor belt 8 is conveyed in the arrow X direction.

Figure 2:
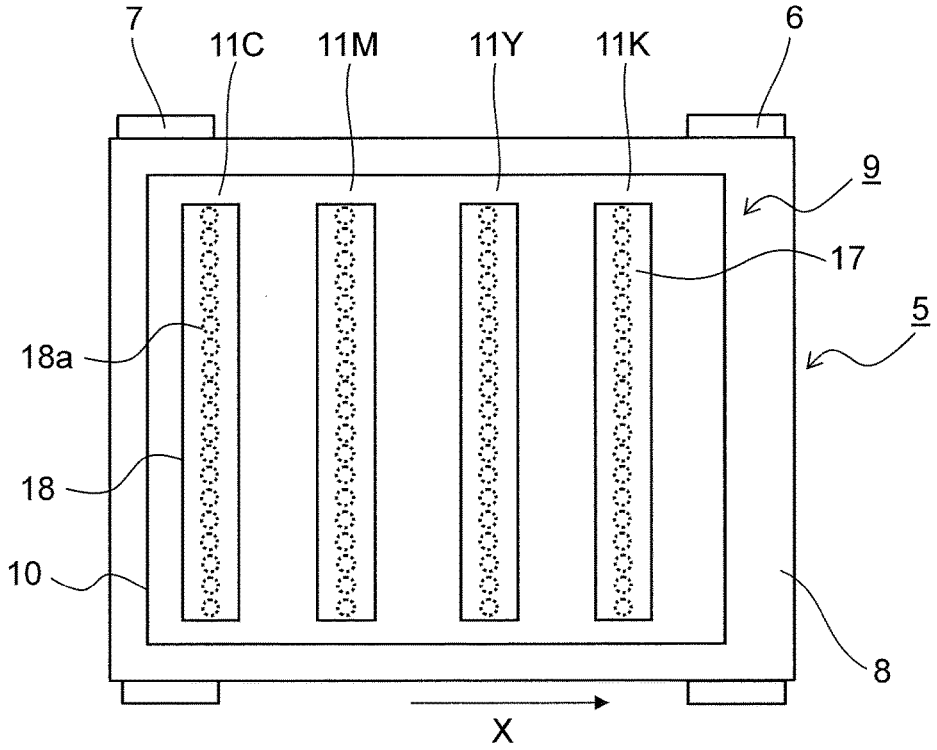
FIG. 2 is a diagram of a first conveying unit and a recording portion viewed from above of the inkjet recording apparatus shown in FIG. 1.

The recording portion 9 includes a head housing 10, and line heads 11C, 11M, 11Y, and 11K held by the head housing 10. These line heads 11C to 11K are supported at a height such that a predetermined space (e.g. 1 mm) is formed between a conveying surface of the first conveyor belt 8 and the heads, and, as shown in FIG. 2, is constituted of one or more (one in this description) recording head 17 extending in a sheet width direction (up/down direction in FIG. 2) perpendicular to the sheet conveying direction.

Figure 3:
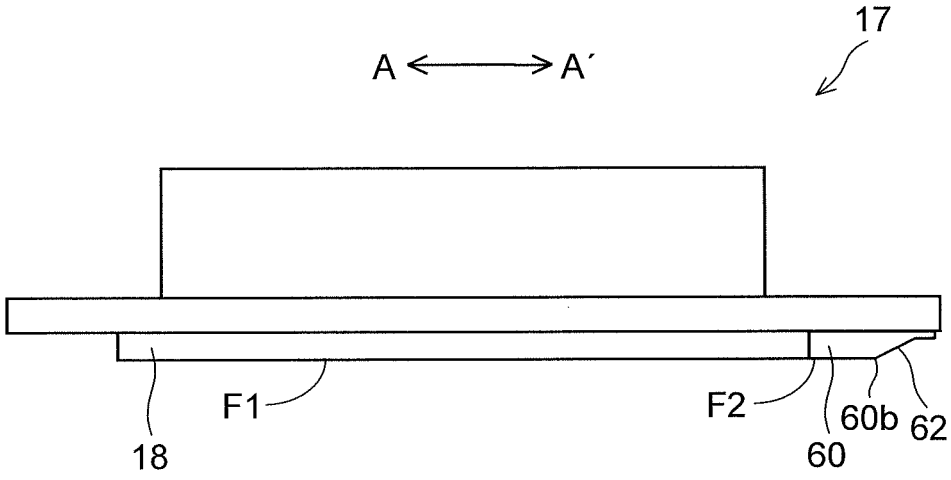
FIG. 3 is a diagram of the recording head constituting a line head of the recording portion.
Figure 4:
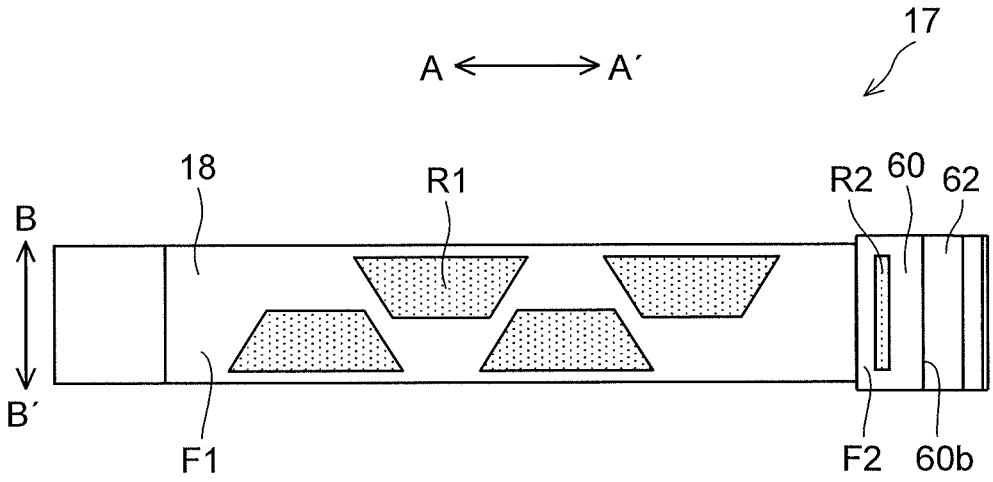
FIG. 4 is a diagram of the recording head viewed from an ink ejection surface side.

As shown in FIGS. 3 and 4, an ink ejection surface F1 of a head portion (ink ejection head portion) 18 of the recording head 17 is provided with an ink ejection region R1 in which multiple ink ejection ports 18*a* (see FIG. 2) are arranged. Note that at least the ink ejection surface F1 of the head portion 18 is made of stainless steel (SUS), for example. Water repellent treatment is performed on the ink ejection surface F1 by applying fluorine or silicone water repellent, and a contact angle with water is 113° in this description.

The recording head 17 constituting the line heads 11C to 11K is supplied with four color (cyan, magenta, yellow, and black) ink stored in ink tanks (not shown) for each color of the line heads 110 to 11K, respectively.

Each recording head 17 ejects ink from the ink ejection port 18*a* to the paper sheet S sucked and held by the conveying surface of the first conveyor belt 8 so as to be conveyed according to image data received from an external computer based on a control signal from the control unit 110 (see FIG. 1). In this way, on the paper sheet S on the first conveyor belt 8, the cyan, magenta, yellow, and black color ink are superimposed to form a color image.

In addition, the recording head 17 is provided with a cleaning liquid supply member (cleaning liquid supplying head portion) 60 for supplying cleaning liquid. The cleaning liquid supply member 60 is disposed adjacent to the head portion 18 on an upstream side (right side in FIG. 3) of the same in a wiping direction of a wiper 35 described later. In addition, the cleaning liquid supply member 60 has an inclined surface 62 that is inclined downward toward the downstream side in the wiping direction and a cleaning liquid supply surface (supply port formation surface) F2 extending from a downstream end of the inclined surface 62 in the wiping direction (a lower end in FIG. 3, which is a connecting part 60*b* described later) toward the ink ejection surface F1. The cleaning liquid supply surface F2 is disposed to be substantially flush and parallel with the ink ejection surface F1.

The cleaning liquid supply surface F2 includes a cleaning liquid supply region R2 in which multiple cleaning liquid supply ports 60*a* for supplying cleaning liquid (see FIG. 5) are arranged. Note that the cleaning liquid supply member 60 is made of resin or SUS, for example. A detailed structure of the cleaning liquid supply member 60 is descried later.

With reference to FIG. 1 again, a second conveying unit 12 is disposed on the downstream side (the right side in FIG. 1) of the first conveying unit 5 in the sheet conveying direction. The second conveying unit 12 has a structure including a second drive roller 13, a second driven roller 14, and a second conveyor belt 15 stretched between the second drive roller 13 and the second driven roller 14. The second drive roller 13 is driven to rotate in the clockwise direction, and hence the paper sheet S held on the second conveyor belt 15 is conveyed in the arrow X direction.

The paper sheet S with an ink image recorded by the recording portion 9 is conveyed to the second conveying unit 12, and the ink ejected onto the surface of the paper sheet S is dried while the paper sheet S passes through the second conveying unit 12. In addition, a wipe unit 19 and a cap unit 90 are disposed below the second conveying unit 12. When a wiping operation by the wiper 35 described later is performed, the first conveying unit 5 moves downward, and the wipe unit 19 moves to below the recording portion 9, wipes off the ink ejected forcibly from the ink ejection ports 18*a* and the cleaning liquid supplied from the cleaning liquid supply port 60*a* of the recording head 17, and collects the wiped ink and cleaning liquid. When capping the ink ejection surface F1 of the recording head 17 (see FIG. 3), the first conveying unit 5 moves downward, the cap unit 90 moves horizontally to below the recording portion 9, and further moves upward so as to be attached to the lower surface of the recording head 17.

In addition, the downstream side of the second conveying unit 12 in the paper sheet conveying direction is provided with a discharge roller pair 16 for discharging the paper sheet S with the recorded image to the outside of the apparatus main body, and the downstream side of the discharge roller pair 16 is provided with a discharge tray (not shown) on which the paper sheet S is placed after being discharged to the outside of the apparatus.

The wipe unit 19 is constituted of a plurality of wipers 35 capable of moving along the ink ejection surface F1 (see FIG. 8), a substantially rectangular carriage (not shown) to which a plurality of wipers 35 are fixed, and a support frame (not shown) for supporting the carriage. The carriage (not shown) is supported in a manner capable of sliding in an arrow AA' direction with respect to the support frame (not shown).

The wiper 35 is an elastic member (a rubber member made of EPDM, for example) for wiping off the cleaning liquid supplied from the cleaning liquid supply ports 60*a* (see FIG. 5) of each recording head 17. The wiper 35 is made to be in pressure contact with a predetermined position (pressure contact start position P (see FIG. 5)) on the inclined surface 62 of the cleaning liquid supply member 60, and wipes the cleaning liquid supply surface F2 and the ink ejection surface F1 in a predetermined direction (arrow A direction) when the carriage (not shown) moves. Note that the wipe unit 19 including the wiper 35 and the recording head 17 constitute a head cleaning mechanism.

Next, a structure of the cleaning liquid supply member 60 is described in detail.

Figure 5:
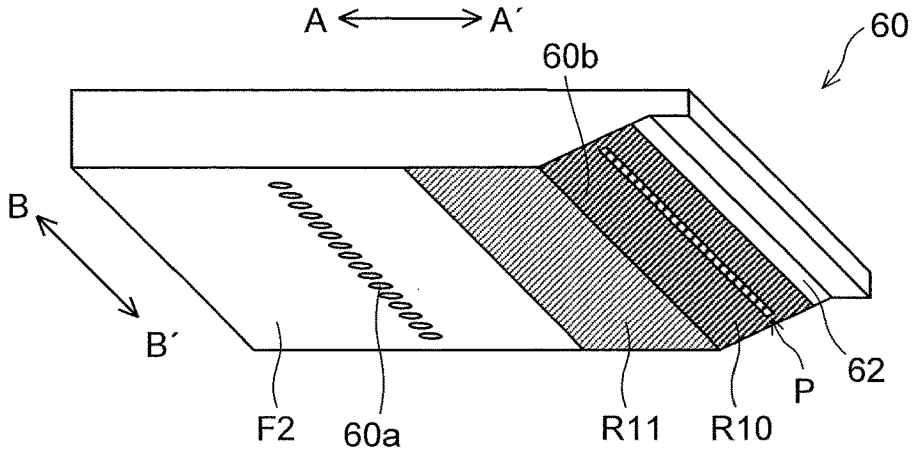
FIG. 5 is a diagram of a cleaning liquid supply member of the recording head viewed from obliquely below.
Figure 6:
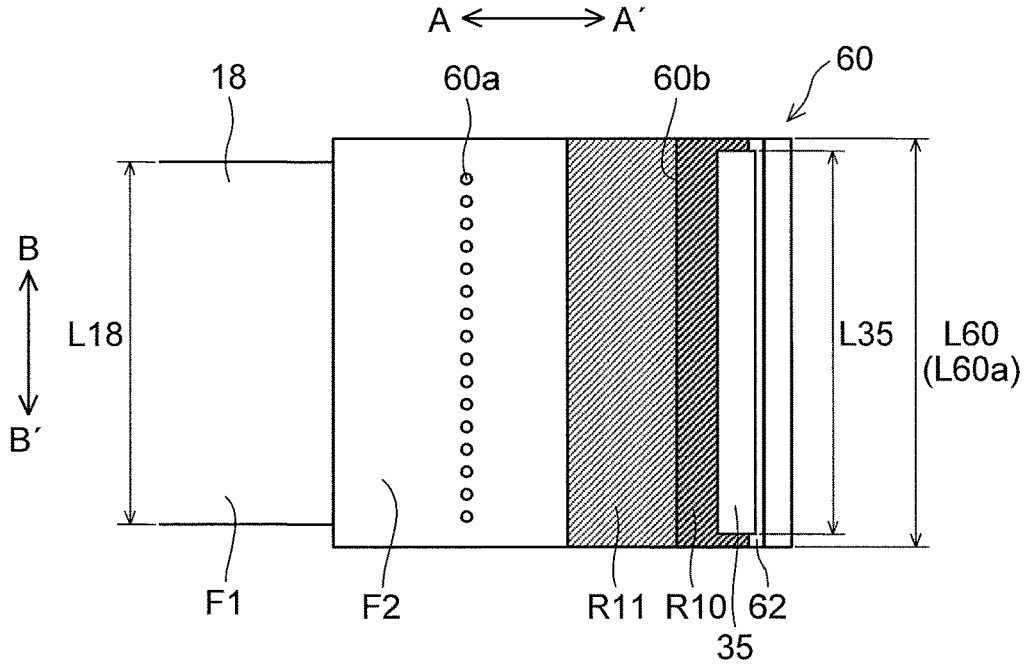
FIG. 6 is a diagram of the cleaning liquid supply member and a head portion of the recording head viewed from below.

As shown in FIGS. 5 and 6, a plurality of the cleaning liquid supply ports 60*a* are arranged at a predetermined pitch in a head width direction (arrow BB' direction) perpendicular to the wiping direction (arrow A direction). Note that only one row of the plurality of cleaning liquid supply ports 60*a* arranged in the head width direction is shown in the diagram, but a plurality of the rows may be disposed adjacent to each other in the wiping direction (arrow A direction).

A length L60 of the cleaning liquid supply surface F2 and the inclined surface 62 of the cleaning liquid supply member 60 in the head width direction (arrow BB' direction) is larger than a length L18 of the ink ejection surface F1 of the head portion 18 in the head width direction. In addition, a length L35 of the wiper 35 in the head width direction is smaller than the length L60 of the cleaning liquid supply surface F2 and the inclined surface 62 in the head width direction, and is larger than the length L18 of the ink ejection surface F1 in the head width direction.

The inclined surface 62 is provided with a water repellent region R10 at least from the pressure contact start position P (start position of the pressure contact with the wiper 35 in the wiping operation) to a position on an upstream side of the cleaning liquid supply port 60*a* in the wiping direction (position on the downstream side of the pressure contact start position P in the wiping direction). Note that, in the diagram, for easy understanding, the pressure contact start position P and the water repellent region R10 are shown with hatching. In this embodiment, the water repellent region R10 is formed from a position on the upstream side of the pressure contact start position P in the wiping direction to the connecting part 60*b* between the inclined surface 62 and the cleaning liquid supply surface F2 (downstream end of the inclined surface 62 in the wiping direction). In addition, the water repellent region R10 is formed in the entire region in the head width direction (arrow BB' direction) of the inclined surface 62. Therefore, a length L60*a* of the water repellent region R10 in the head width direction is the same as the length L60 of the inclined surface 62 in the head width direction and is large than the length L35 of the wiper 35 in the head width direction.

As a method of forming the water repellent region R10, there is a method of applying fluorine or silicone water repellent to the region in which the water repellent region R10 is to be formed. A contact angle with water of the water repellent region R10 is 90° or larger (95° in this description).

In addition, a hydrophilic region R11 is provided to the downstream side of the water repellent region R10 in the wiping direction, which is close to the connecting part 60*b* between the inclined surface 62 and the cleaning liquid supply surface F2. Note that, in the diagram, for easy understanding, the hydrophilic region R11 is shown with hatching. The hydrophilic region R11 is formed to have higher wettability to water than in other part of the cleaning liquid supply member 60 (e.g. the water repellent region R10 and the cleaning liquid supply surface F2). In this embodiment, the hydrophilic region R11 is disposed in the cleaning liquid supply surface F2 and is formed from the connecting part 60*b* to a position before the cleaning liquid supply region R2 (position between the connecting part 60*b* and the cleaning liquid supply region R2). Note that the hydrophilic region R11 may be disposed on the inclined surface 62 as long as it is close to the connecting part 60*b*.

The hydrophilic region R11 is formed so as to extend in the head width direction (arrow BB' direction). In addition, the hydrophilic region R11 is formed in a strip shape continuous over substantially the entire region in the head width direction in a vicinity of the connecting part 60*b*.

As a method of forming the hydrophilic region R11, there is a method of applying hydrophilic coating agent to the region in which the hydrophilic region R11 is to be formed, or a method of roughening the surface. A contact angle with water of the hydrophilic region R11 is less than 90° (60° in this description), which is smaller than a contact angle with water of the cleaning liquid supply surface F2 (excluding the hydrophilic region R11) (70° in this description) or the contact angle with water of the water repellent region R10 (95° in this description).

Figure 7:
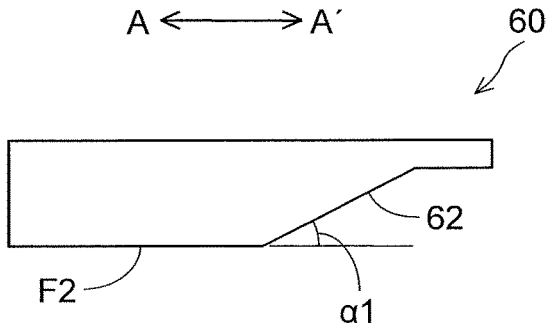
FIG. 7 is a diagram showing a structure of the cleaning liquid supply member.
Figure 8:
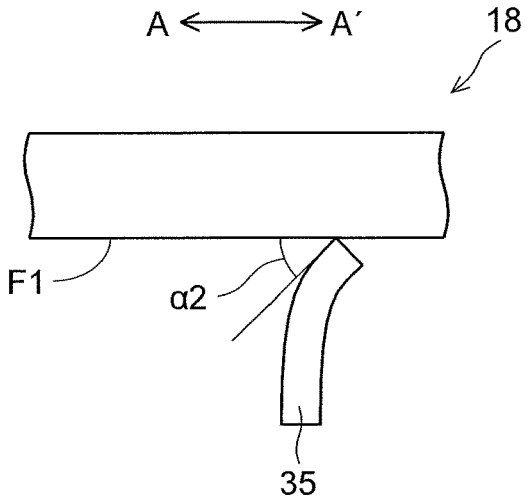
FIG. 8 is a diagram showing a state in which the wiper is moving in an arrow A direction in pressure contact with the ink ejection surface.

In addition, as shown in FIGS. 7 and 8, the cleaning liquid supply member 60 is formed so that an inclination angle $\alpha 1$ of the inclined surface 62 with respect to the ink ejection surface F1 and the cleaning liquid supply surface F2 (see FIG. 7) is smaller than a pressure contact angle $\alpha 2$ of the tip portion of the wiper 35 with respect to the ink ejection surface F1 (see FIG. 8) in the state where the wiper 35 is wiping the ink ejection surface F1. Specifically, the pressure contact angle $\alpha 2$ of the tip portion of the wiper 35 with respect to the ink ejection surface F1 and the cleaning liquid supply surface F2 is set to approximately 45°. The inclination angle $\alpha 1$ of the inclined surface 62 with respect to the ink ejection surface F1 and the cleaning liquid supply surface F2 is set to preferably 15° or more and less than 45°, and more preferably 30° or more and less than 40°.

Figure 9:
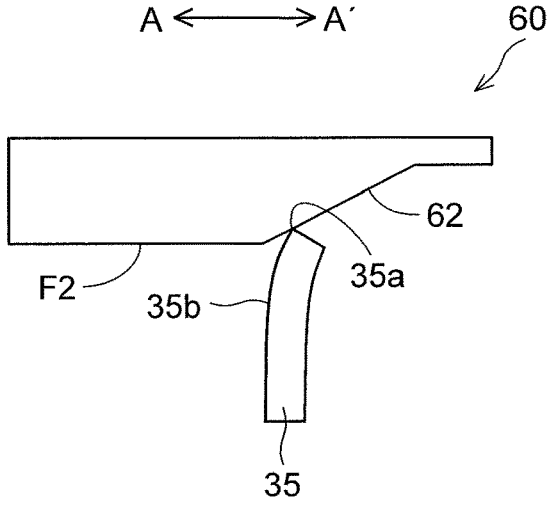
FIG. 9 is a diagram showing a state in which the wiper is moving in the arrow A direction in pressure contact with an inclined surface of the cleaning liquid supply member.

Because the inclination angle $\alpha 1$ is formed to be smaller than the pressure contact angle $\alpha 2$, as shown in FIG. 9, when the wiper 35 is moved in the wiping direction (left direction in FIG. 9), only a corner part 35*a* of the tip of the wiper 35 on the downstream side in the wiping direction contacts with the inclined surface 62. In other words, a side surface 35*b* of the wiper 35 on the downstream side in the wiping direction does not contact with the inclined surface 62.

The cleaning liquid supply member 60 is connected to a tank (not shown) for storing the cleaning liquid via a cleaning liquid supply passage (not shown). The cleaning liquid supply passage is provided with a cleaning liquid supply pump (not shown) for pumping up the cleaning liquid from the tank so as to send the same to the cleaning liquid supply member 60.

In this inkjet recording apparatus 100, in order to clean the ink ejection surface F1 of the recording head 17, at start of printing after a long stop period or between printing operations, a recovery operation of the recording head 17 is performed as preparation for a next printing operation, in which all the ink ejection ports 18*a* of the recording head 17 forcibly eject ink, while all the cleaning liquid supply ports 60*a* of the recording head 17 (see FIG. 5) supplies the cleaning liquid to the cleaning liquid supply region R2, and the wiper 35 wipes the ink ejection surface F1.

Next described is the recovery operation of the recording head 17 using the wipe unit 19 in the inkjet recording apparatus 100 of this embodiment. Note that the recovery operation of the recording head 17 described below is performed by controlling operations of the recording head 17, the wipe unit 19, the cleaning liquid supply pump, and the like based on the control signal from the control unit 110 (see FIG. 1).

Figure 10:
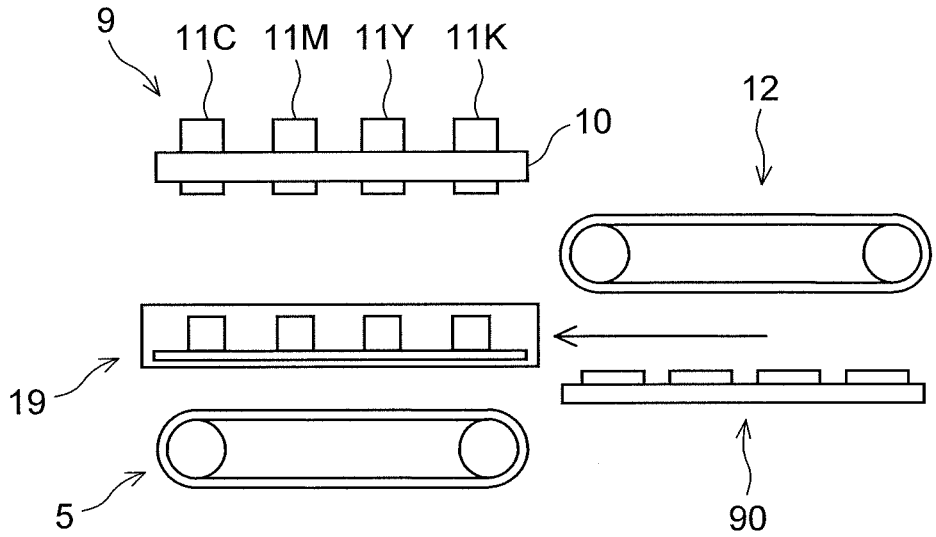
FIG. 10 is a diagram showing a state in which a maintenance unit is disposed below the recording portion.

When performing the recovery operation of the recording head 17, first as shown in FIG. 10, the control unit 110 (see FIG. 1) controls the first conveying unit 5 positioned below the recording portion 9 to move downward. Further, the control unit 110 controls the wipe unit 19 disposed below the second conveying unit 12 to move horizontally so as to be positioned between the recording portion 9 and the first conveying unit 5. In this state, the wiper 35 of the wipe unit 19 (see FIG. 11) is positioned below the ink ejection surface F1 and the cleaning liquid supply surface F2 of the recording head 17 (see FIG. 11).

(Cleaning Liquid Supply Operation)

Figure 11:
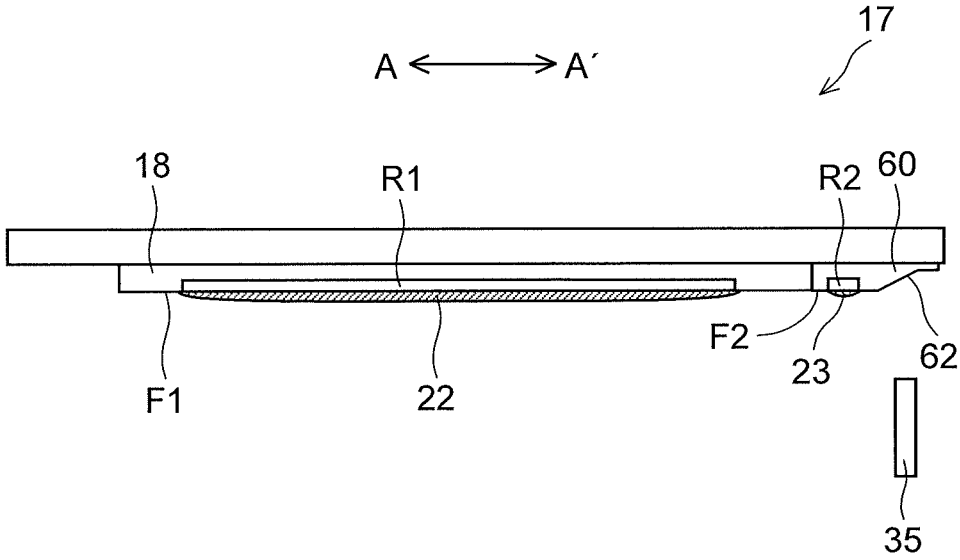
FIG. 11 is a diagram showing a state in which the wiper is disposed below the recording head.

Prior to the wiping operation (wipe operation described later), the control signal from the control unit 110 (see FIG. 1) drives (turns on) the cleaning liquid supply pump (not shown), and cleaning liquid 23 is supplied to the recording head 17 as shown in FIG. 11. In this case, the cleaning liquid 23 is supplied by a predetermined amount from the cleaning liquid supply port 60*a* to the cleaning liquid supply surface F2. Note that, in the diagram, for easy understanding, the cleaning liquid 23 is shown with hatching.

(Ink Extrusion Operation)

In addition, prior to the wiping operation (wipe operation described later), as shown in FIG. 11, the control unit 110 (see FIG. 1) supplies ink 22 to the recording head 17. The supplied ink 22 is forcibly extruded (purged) from the ink ejection port 18*a*. By this purging operation, thickened ink, foreign matters, and air bubbles in the ink ejection port 18*a* are discharged from the ink ejection port 18*a*. In this case, the purged ink 22 is extruded to the ink ejection surface F1 along a shape of the ink ejection region R1 in which the ink ejection port 18*a* exists. Note that, in the diagram, for easy understanding, the ink (purged ink) 22 is shown with hatching.

(Wipe Operation)

Figure 12:
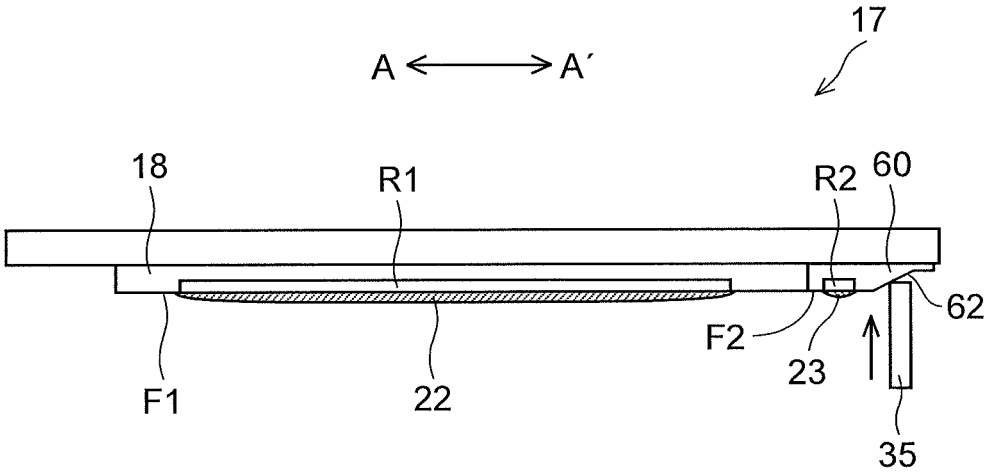
FIG. 12 is a diagram showing a state in which the wiper is moved upward from the state of FIG. 11 so as to be in pressure contact with the cleaning liquid supply member.

As shown in FIG. 12, the control unit 110 controls the wiper 35 to move upward so as to contact with the inclined surface 62 of the cleaning liquid supply member 60 of the recording head 17 by a predetermined pressure. In this case, the wiper 35 is moved upward so that the upper surface of the wiper 35 becomes higher than the ink ejection surface F1 and the cleaning liquid supply surface F2 by approximately 1 mm. Note that, at a time point when the wiper 35 is moved upward, the wiper 35 may not be in pressure contact with the inclined surface 62. In other words, the wiper 35 may be moved upward at a position shifted to the right from the position in FIG. 12.

Figure 13:
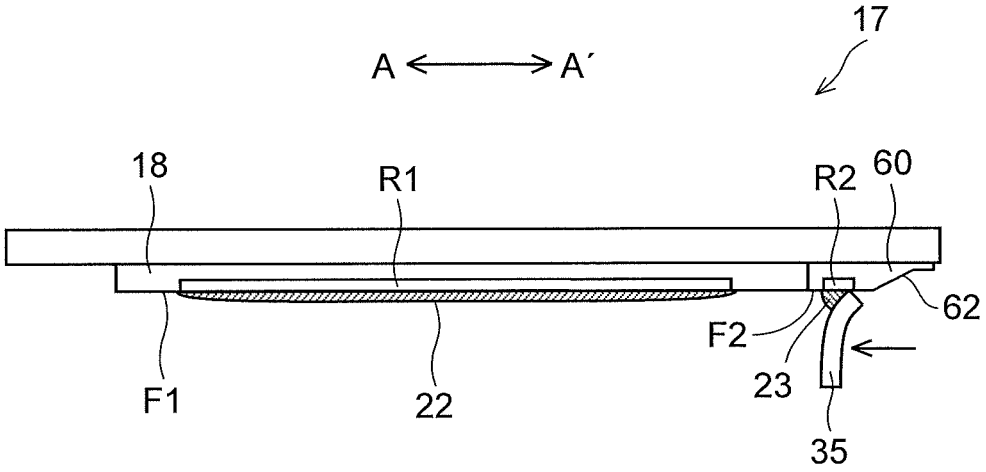
FIG. 13 is a diagram showing a state in which the wiper is moved in the arrow A direction in pressure contact with the cleaning liquid supply member from the state of FIG. 12.

In the state where the tip of the wiper 35 is in pressure contact with the inclined surface 62 of the cleaning liquid supply member 60, the control unit 110 controls the wiper 35 to move along the cleaning liquid supply surface F2 in a direction toward the ink ejection region R1 (arrow A direction) as shown in FIG. 13. In this way, the wiper 35 moves in the direction toward the ink ejection region R1 in a state holding the cleaning liquid 23.

Figure 14:
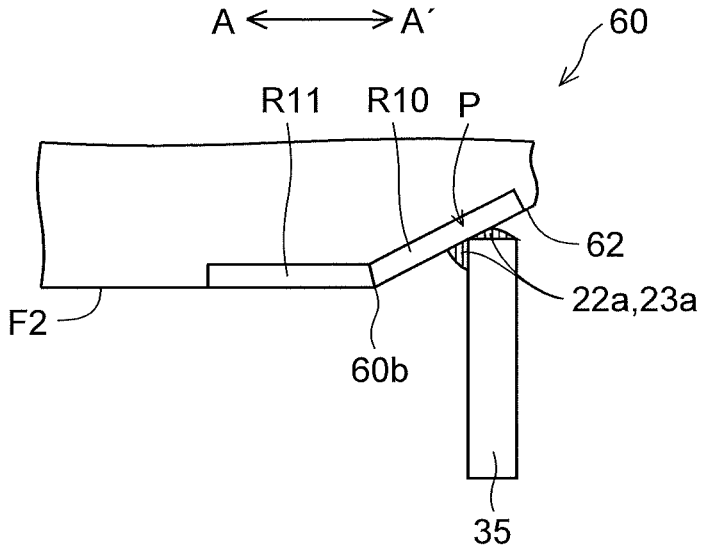
FIG. 14 is a diagram showing a state in which the wiper is made to be in pressure contact with the inclined surface in case where ink or cleaning liquid adhered to a tip portion of the wiper in the last wiping operation remains.

In this case, as shown in FIG. 14, if ink 22*a* or cleaning liquid 23*a* adhered to the tip portion of the wiper 35 in the last wiping operation remains, the ink 22*a* or the cleaning liquid 23*a* adhered to the tip portion of the wiper 35 is adhered (transferred) to the pressure contact start position P on the inclined surface 62.

Figure 15:
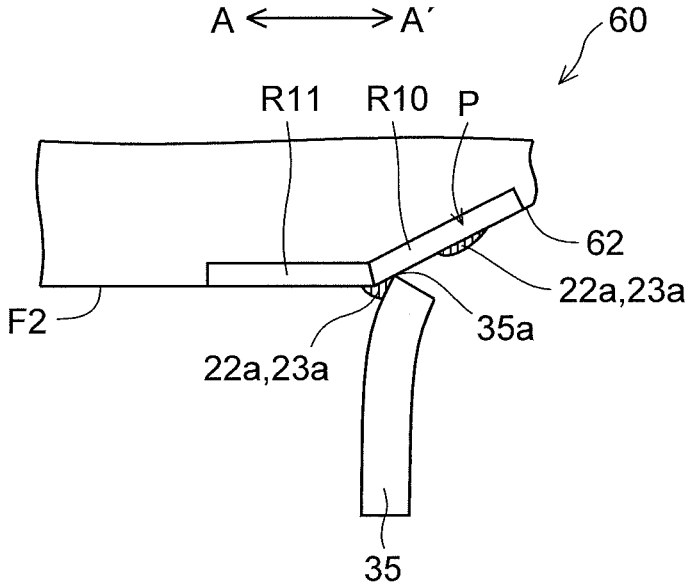
FIG. 15 is a diagram showing a state in which the wiper is moved in the arrow A direction in pressure contact with the cleaning liquid supply member from the state of FIG. 14.
Figure 16:
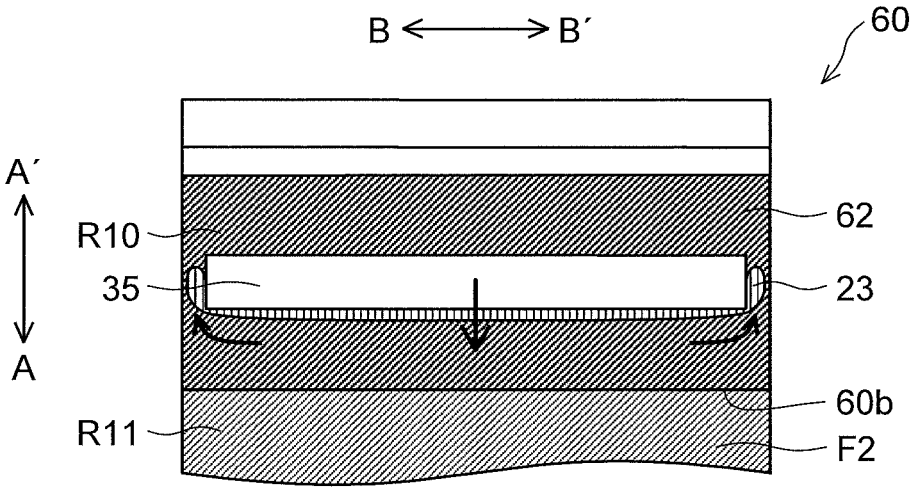
FIG. 16 is a diagram showing a state in which the wiper is moved in the arrow A direction in pressure contact with the cleaning liquid supply member from the state of FIG. 14 viewed from below.

As shown in FIG. 9, when the wiper 35 moves in the wiping direction (arrow A direction) below the inclined surface 62, only the corner part 35*a* of the tip of the wiper 35 contacts with the inclined surface 62. Therefore, as shown in FIG. 15, a part of the ink 22*a* or the cleaning liquid 23*a* adhered to the inclined surface 62 (part on the downstream side of the corner part 35*a* of the wiper 35 in the wiping direction) is wiped off by the wiper 35. In this case, as shown in FIG. 16, when the wiper 35 is moved along the inclined surface 62, the ink 22*a* or the cleaning liquid 23*a* flows to both sides of the wiper 35 in the head width direction (arrow BB' direction) and moves to both sides of the water repellent region R10 in the head width direction. The ink 22*a* or the cleaning liquid 23*a* flows in the water repellent region R10 to the downstream side in the wiping direction (arrow A direction, downward).

In addition, the rest of the ink 22*a* or the cleaning liquid 23*a* adhered (transferred) from the tip portion of the wiper 35 to the inclined surface 62 flows in the water repellent region R10 to the downstream side in the wiping direction (arrow A direction, downward) as shown in FIG. 15.

Figure 17:
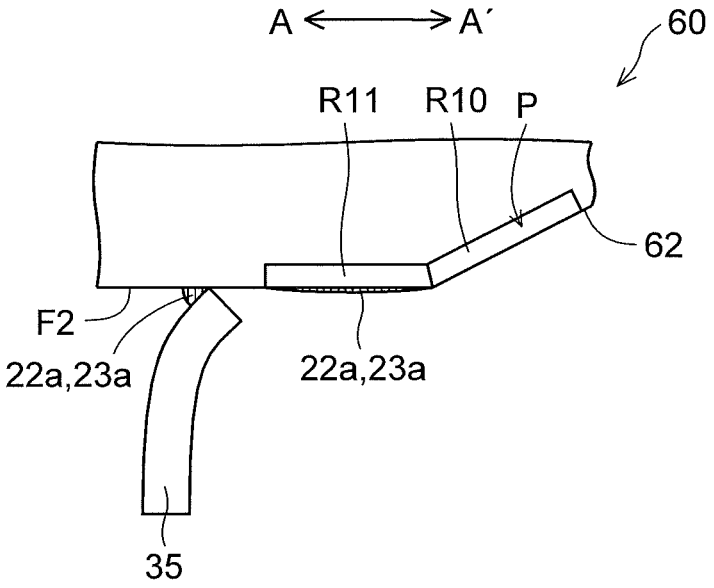
FIG. 17 is a diagram showing a state in which the wiper is further moved in the arrow A direction in pressure contact with the cleaning liquid supply member from the state of FIG. 15.

After that, the ink 22*a* or the cleaning liquid 23*a* after flowing in the water repellent region R10 reaches the hydrophilic region R11 and is held in a state wetting and spreading in the entire hydrophilic region R11 as shown in FIG. 17. The ink 22*a* or the cleaning liquid 23*a* held in the hydrophilic region R11 is wiped off by the wiper 35 in the next wiping operation.

Figure 18:
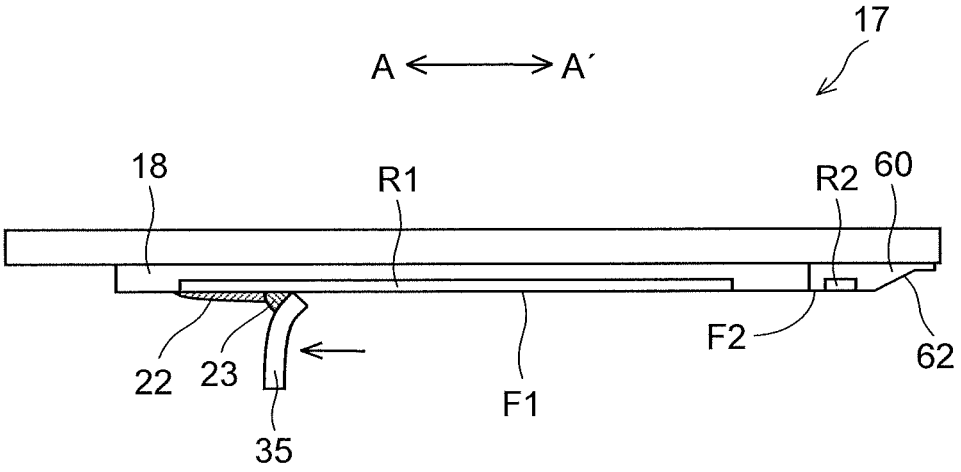
FIG. 18 is a diagram showing a state in which the wiper is further moved in the arrow A direction from the state of FIG. 13.

After the state shown in FIG. 13, the wiper 35 moves in the ink ejection surface F1 in the left direction (arrow A direction) while maintaining the state holding the cleaning liquid 23 and the purged ink 22 as shown in FIG. 18. In this case, ink droplets (waste ink) adhered to the ink ejection surface F1 and hardened are melted by the cleaning liquid 23 and the purged ink 22, and are wiped off by the wiper 35. Then, the wiper 35 further moves in the left direction (arrow A direction). When the wiper 35 reaches a position opposite to the cleaning liquid supply region R2 with respect to the ink ejection region R1, the movement in the left direction is stopped. Note that the cleaning liquid 23 and the waste ink wiped off by the wiper 35 are collected to a cleaning liquid collection tray (not shown) provided to the wipe unit 19.

(Separation Operation)

Figure 19:
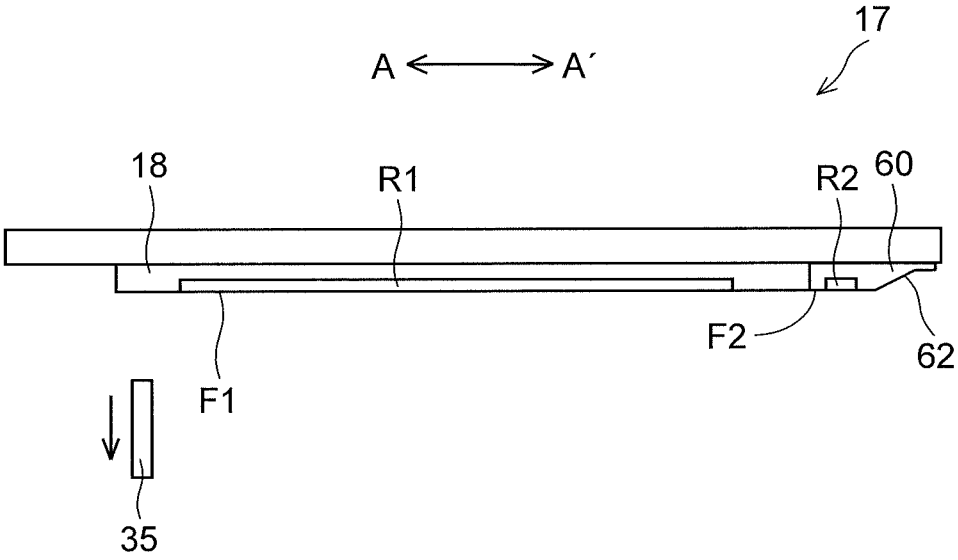
FIG. 19 is a diagram showing a state in which the wiper is further moved in the arrow A direction from the state of FIG. 18 and then is moved downward so as to separate from the ink ejection surface.

After performing the wipe operation, as shown in FIG. 19, the control unit 110 controls the wiper 35 to move downward so as to separate from the ink ejection surface F1.

Finally, the control unit 110 controls the wipe unit 19 disposed between the recording portion 9 and the first conveying unit 5 to move horizontally to be positioned below the second conveying unit 12, and controls the first conveying unit 5 to move upward to a predetermined position. In this way, the recovery operation of the recording head 17 is finished.

In this embodiment, as described above, the control unit 110 controls the wiper 35 to move upward below the inclined surface 62, and the wiper 35 is moved from the position in the wiping direction so that the tip portion of the wiper 35 becomes in pressure contact with the ink ejection surface F1 in a state being warped in the opposite direction to the wiping direction. Therefore, unlike a case where the wiper 35 is in pressure contact perpendicularly with the ink ejection surface F1, it is possible to prevent an increase in a load when the wiper 35 is in pressure contact with the ink ejection surface F1.

In addition, the inclined surface 62 of the recording head 17 is provided with the water repellent region R10, which is formed at least from the pressure contact start position P to a position on the upstream side of the cleaning liquid supply port 60*a* in the wiping direction (the connecting part 60*b* in this description) and has a contact angle with water of 90° or more. In this way, the ink 22*a* or the cleaning liquid 23*a* adhered (transferred) to the inclined surface 62 from the wiper 35 in the wiping operation flows on the inclined surface 62 to a position on the upstream side of the cleaning liquid supply port 60*a* in the wiping direction (the connecting part 60*b* in this description). The ink 22*a* or the cleaning liquid 23*a* flowing on the inclined surface 62 is wiped off by the wiper 35 in the next wiping operation. Therefore, the ink 22*a* or the cleaning liquid 23*a* on the surface of the recording head 17 is prevented from gradually increasing, and hence it is possible to prevent the ink 22*a* or the cleaning liquid 23*a* from contacting and adhering to the paper sheet S, or from dropping to the paper sheet S or the first conveying unit 5.

In addition, as described above, in a vicinity of the connecting part 60*b* between the cleaning liquid supply surface F2 and the inclined surface 62 on the downstream side of the water repellent region R10 in the wiping direction, the hydrophilic region R11 having a contact angle with water smaller than 90° is disposed to extend in the head width direction. In this way, the ink 22*a* or the cleaning liquid 23*a* after flowing to the downstream end (connecting part 60*b*) of the inclined surface 62 wets and spreads to the hydrophilic region R11, and hence the ink 22*a* or the cleaning liquid 23*a* is prevented from hanging down. Therefore, the ink 22*a* or the cleaning liquid 23*a* is more prevented from contacting and adhering to the paper sheet S.

In addition, because the ink 22*a* or the cleaning liquid 23*a* spreads to the hydrophilic region R11 and is held on the same, the ink 22*a* or the cleaning liquid 23*a* is prevented from gathering to the middle part in the head width direction (arrow BB' direction) to be a large droplet and from dropping from the cleaning liquid supply member 60.

In addition, as described above, the hydrophilic region R11 is formed in the substantially entire region in the head width direction near the connecting part 60*b*. In this way, the ink 22*a* or the cleaning liquid 23*a* after flowing in the both ends of the inclined surface 62 in the head width direction can also securely reach the hydrophilic region R11.

In addition, as described above, the water repellent region R10 is formed at least from the pressure contact start position P to the connecting part 60*b* on the inclined surface 62. In this way, the ink 22*a* or the cleaning liquid 23*a* can securely reach the hydrophilic region R11 formed on the cleaning liquid supply surface F2.

In addition, as described above, the contact angle with water (60° in this description) of the hydrophilic region R11 is smaller than the contact angle with water (70° in this description) of the cleaning liquid supply surface F2. In this way, the ink 22*a* or the cleaning liquid 23*a* is prevented from wetting and spreading to the cleaning liquid supply surface F2 beyond the hydrophilic region R11.

In addition, as described above, the water repellent region R10 is formed in the substantially entire region in the head width direction on the inclined surface 62. In this way, the ink 22*a* or the cleaning liquid 23*a* adhered to the both ends of the inclined surface 62 in the head width direction can flow to the downstream side in the wiping direction.

In addition, as described above, the recording head 17 is constituted of the head portion 18 having the ink ejection surface F1, and the cleaning liquid supply member 60 having the inclined surface 62 and the cleaning liquid supply surface F2. In this way, compared with a case where the inclined surface 62 is formed on the head portion 18, the inclined surface 62 can be formed more easily.

In addition, an ink passage route and a cleaning liquid passage route can be formed in different members (the head portion 18 and the cleaning liquid supply member 60) in the recording head 17, and hence the structure of the recording head 17 can be prevented from being complicated.

In addition, as described above, the length L35 of the wiper 35 in the head width direction is smaller than the length L60 of the inclined surface 62 in the head width direction, and the length L60*a* of the water repellent region R10 in the head width direction is larger than the length L35 of the wiper 35 in the head width direction. In this way, when the wiper 35 is moved toward the downstream side in the wiping direction in the state where the wiper 35 is in pressure contact with the inclined surface 62, even if the ink 22*a* or the cleaning liquid 23*a* flows to the both ends of the wiper 35 in the head width direction and moves to the both ends of the water repellent region R10 in the head width direction, the ink 22*a* or the cleaning liquid 23*a* can flow toward the downstream side in the wiping direction thanks to the water repellent region R10.

In addition, as described above, the inclination angle $\alpha 1$ of the inclined surface 62 with respect to the ink ejection surface F1 is smaller than the pressure contact angle $\alpha 2$ of the tip portion of the wiper 35 with respect to the ink ejection surface F1 in the state where the wiper 35 is wiping the ink ejection surface F1. In this way, when the wiper 35 moves in the wiping direction in a state where the wiper 35 is in pressure contact with the inclined surface 62 of the recording head 17, the wiper 35 is not warped more than or equal to the pressure contact angle $\alpha 2$ with respect to the ink ejection surface F1, and hence the wiper 35 moves while only the corner part 35*a* contacts with the inclined surface 62. In other words, the side surface 35*b* of the wiper 35 does not contact with the side surface (inclined surface 62) of the recording head 17. Therefore, the ink 22*a* or the cleaning liquid 23*a* can be prevented more from remaining on the inclined surface 62.

In addition, as described above, the inclination angle $\alpha 1$ is more than or equal to 15° and less than 45°. In this way, the ink 22 and the cleaning liquid 23 can be easily flow toward the downstream end on the inclined surface 62, and only the corner part 35*a* of the tip of the wiper 35 can contact with the inclined surface 62.

Second Embodiment

Figure 20:
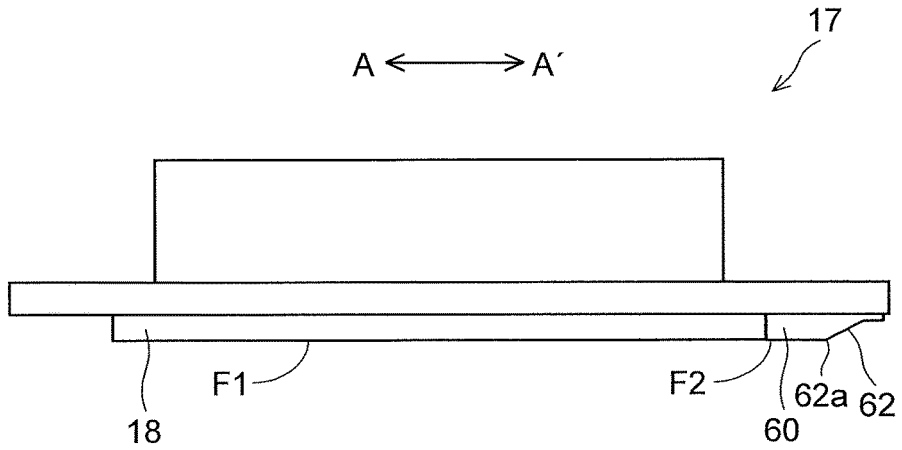
FIG. 20 is a diagram of the recording head constituting the line head of the recording portion of the inkjet recording apparatus of a second embodiment of the present disclosure.
Figure 21:
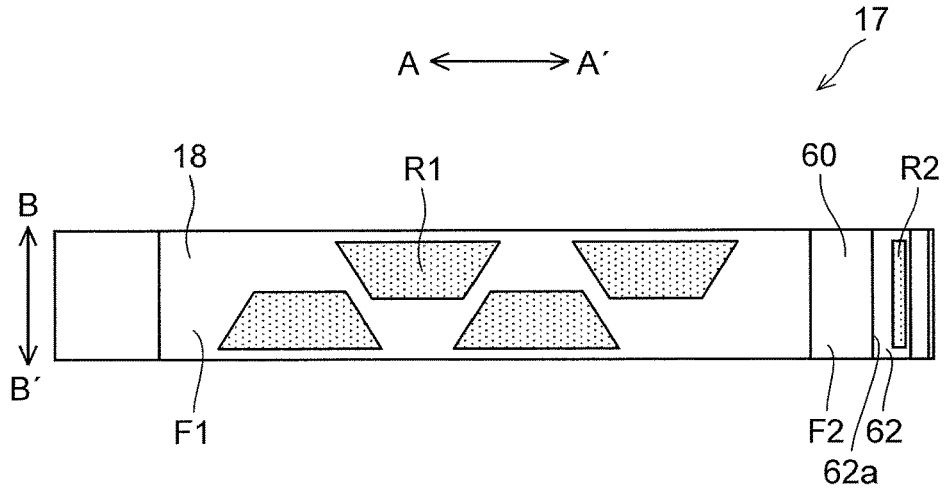
FIG. 21 is a diagram of the recording head of the inkjet recording apparatus of the second embodiment of the present disclosure viewed from the ink ejection surface side.

As shown in FIGS. 20 and 21, in the inkjet recording apparatus 100 of the second embodiment of the present disclosure, the cleaning liquid supply member 60 has the inclined surface 62 that is inclined downward toward the downstream side in the wiping direction, and a lower surface F2 extending from a downstream end 62*a* of the inclined surface 62 in the wiping direction (lower end in FIG. 20) toward the ink ejection surface F1. The lower surface F2 is disposed to be substantially flush and parallel with the ink ejection surface F1.

The inclined surface 62 includes the cleaning liquid supply region R2 in which the multiple cleaning liquid supply ports 60*a* for supplying the cleaning liquid (see FIG. 22) are arranged. Note that this embodiment is different from the first embodiment described above in that the cleaning liquid supply port 60*a* and the cleaning liquid supply region R2 are not disposed on the lower surface F2. A detailed structure of the cleaning liquid supply member 60 is described later.

The wiper 35 is in pressure contact with the inclined surface 62 of the cleaning liquid supply member 60 at a predetermined position on the downstream side of the cleaning liquid supply region R2 (see FIG. 21) in the wiping direction (at a pressure contact start position Ps (see FIG. 22)), and wipes the lower surface F2 and the ink ejection surface F1 in a predetermined direction (arrow A direction) when the carriage (not shown) moves. Note that the wipe unit 19 including the wiper 35 and the recording head 17 constitute the head cleaning mechanism.

Next, a structure of the cleaning liquid supply member 60 is described in detail.

Figure 22:
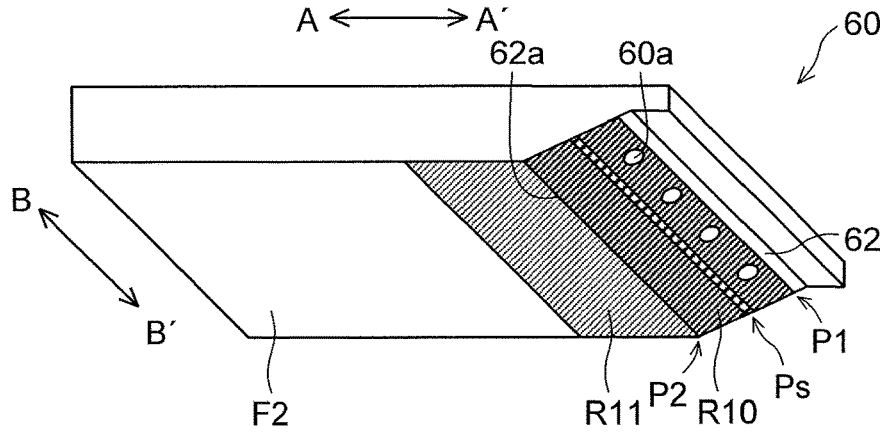
FIG. 22 is a diagram of the cleaning liquid supply member of the recording head of the inkjet recording apparatus of the second embodiment of the present disclosure viewed from obliquely below.
Figure 23:
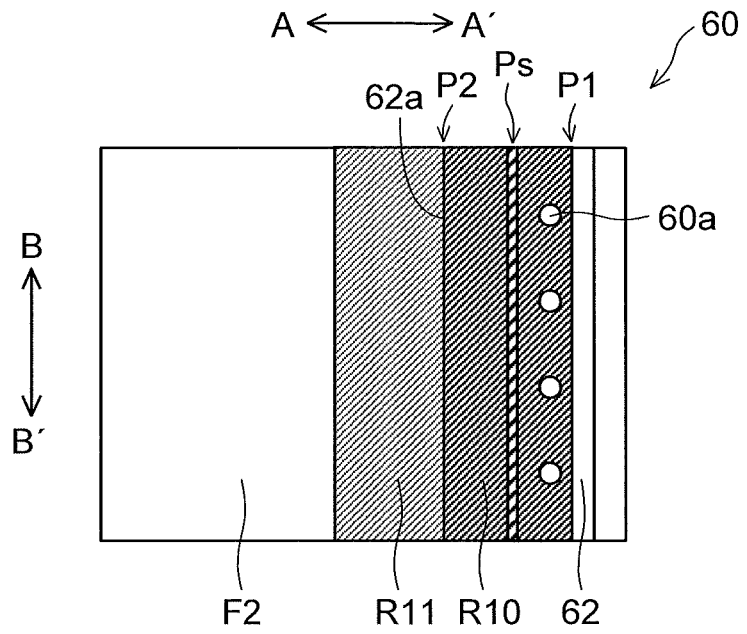
FIG. 23 is a diagram of the cleaning liquid supply member of the recording head of the inkjet recording apparatus of the second embodiment of the present disclosure viewed from below.

As shown in FIGS. 22 and 23, in the inclined surface 62, the cleaning liquid supply port 60*a* is disposed on the upper side (upstream side in the wiping direction) of the pressure contact start position Ps at which the pressure contact by the wiper 35 is started in the wiping operation. Note that, in the diagram, for easy understanding, the pressure contact start position Ps is shown with hatching. In addition, a plurality of the cleaning liquid supply ports 60*a* are arranged at a predetermined pitch in the head width direction (arrow BB' direction) perpendicular to the wiping direction (arrow A direction). Note that, in the diagram, only one row of the plurality of cleaning liquid supply ports 60*a* arranged in the head width direction is shown in the diagram, but a plurality of the rows may be disposed adjacent to each other in the wiping direction (arrow A direction).

The inclined surface 62 is provided with the water repellent region R10 at least from a position P1 on the upstream side (the right side in FIG. 23) of the pressure contact start position Ps in the wiping direction to a position P2 on the downstream side of the same. Note that, in the diagram, for easy understanding, the water repellent region R10 is shown with hatching. In this embodiment, the water repellent region R10 is formed from the position P1 on the upstream side of the cleaning liquid supply port 60*a* in the wiping direction to the downstream end 62*a* of the inclined surface 62 in the wiping direction (connecting part between the inclined surface 62 and the lower surface F2, the position P2 on the downstream side). In addition, the water repellent region R10 is formed over the entire region in the head width direction (arrow BB' direction) of the inclined surface 62.

As a method of forming the water repellent region R10, there is a method of applying fluorine or silicone water repellent to the region in which the water repellent region R10 is to be formed. A contact angle with water of the water repellent region R10 is 90° or larger (95° in this description).

In addition, the hydrophilic region R11 is provided to the downstream side of the water repellent region R10 in the wiping direction, which is close to the downstream end 62*a* of the inclined surface 62 in the wiping direction. Note that, in the diagram, for easy understanding, the hydrophilic region R11 is shown with hatching. The hydrophilic region R11 is formed to have higher wettability to water than in other part of the cleaning liquid supply member 60 (e.g. the water repellent region R10 and the lower surface F2). In this embodiment, the hydrophilic region R11 is disposed in the lower surface F2 and is formed in a predetermined length from the connecting part between the inclined surface 62 and the lower surface F2 (downstream end 62*a*) toward the downstream side in the wiping direction. Note that the hydrophilic region R11 may be disposed on the inclined surface 62 as long as it is close to the downstream end 62*a*.

The hydrophilic region R11 is formed so as to extend in the head width direction (arrow BB' direction). In addition, the hydrophilic region R11 is formed in a strip shape continuous over substantially the entire region in the head width direction in a vicinity of the downstream end 62*a*. In this way, as described later, when the cleaning liquid is supplied from the cleaning liquid supply port 60*a* to the inclined surface 62, the cleaning liquid flows on the inclined surface 62 to the downstream side in the wiping direction (the left side in FIGS. 22 and 23). When reaching the hydrophilic region R11, the cleaning liquid wets and spreads in the head width direction.

As a method of forming the hydrophilic region R11, there is a method of applying hydrophilic coating agent to the region in which the hydrophilic region R11 is to be formed, or a method of roughening the surface. As the hydrophilic coating agent, there is a titanium oxide or polysilicate coating agent. A contact angle with water of the hydrophilic region R11 is less than 90° (60° in this description), which is smaller than a contact angle with water of the lower surface F2 (excluding the hydrophilic region R11) (70° in this description) or the contact angle with water of the water repellent region R10 (95° in this description).

Figure 24:
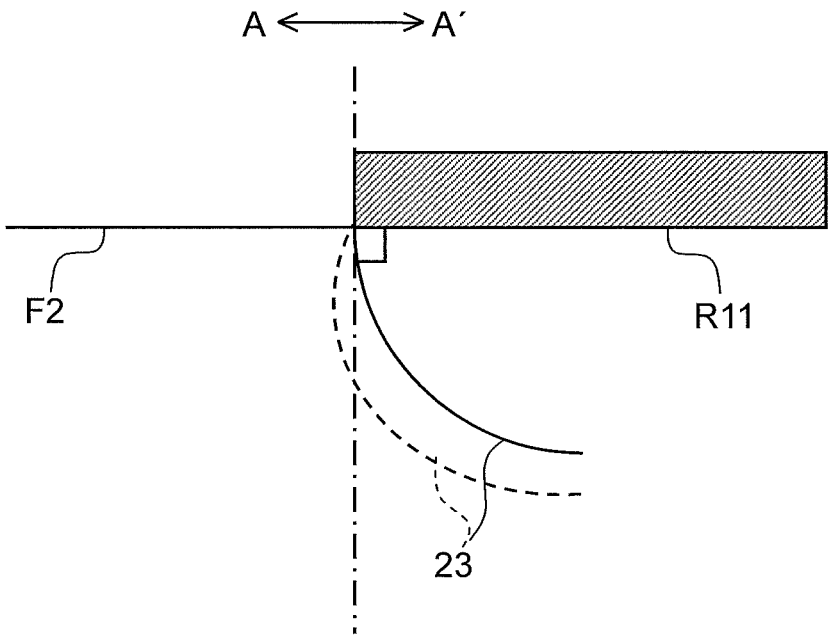
FIG. 24 is a diagram showing a manner in which the cleaning liquid is held in a hydrophilic region near a boundary between a lower surface of the cleaning liquid supply member and the hydrophilic region in the inkjet recording apparatus of the second embodiment of the present disclosure.

As shown in FIG. 24, when the contact angle with water of the hydrophilic region R11 is 90° or more, the aqueous cleaning liquid 23 protrudes by surface tension from the hydrophilic region R11 to the lower surface F2 side (ink ejection surface F1 side) (as shown by a broken line in FIG. 24). Therefore, the cleaning liquid 23 easily flows to the lower surface F2 side (ink ejection surface F1 side) due to a vibration or an impact. If the recovery operation of the recording head 17 described later is not performed, when the cleaning liquid 23 flows to the ink ejection surface F1, ejection property of ink from the ink ejection port 18*a* may be adversely affected.

On the other hand, when the contact angle with water of the hydrophilic region R11 is less than 90°, the aqueous cleaning liquid 23 does not protrude from the hydrophilic region R11 to the lower surface F2 side (ink ejection surface F1 side) (as shown by a solid line in FIG. 24). Therefore, it is preferred that the contact angle with water of the hydrophilic region R11 be less than 90°. Note that because most liquid has a smaller surface tension than water, by setting the contact angle with water of the hydrophilic region R11 to be less than 90°, the cleaning liquid 23 hardly flow from the hydrophilic region R11 to the lower surface F2 side (ink ejection surface F1 side) even if the cleaning liquid 23 based on other liquid is used.

In addition, the inclination angle $\alpha 1$ of the inclined surface 62 with respect to the ink ejection surface F1 and the lower surface F2 (see FIG. 7) is formed in the same manner as in the first embodiment described above.

Note that, in this embodiment, as shown in FIG. 21, unlike the first embodiment described above, the lengths in the head width direction (arrow BB' direction) of the lower surface F2 and the inclined surface 62 of the cleaning liquid supply member 60 are formed to be substantially the same as the length in the head width direction of the ink ejection surface F1 of the head portion 18. In addition, the length in the head width direction of the wiper 35 is larger than the lengths in the head width direction of the lower surface F2, the inclined surface 62 and the ink ejection surface F1.

Other structures of the second embodiment are the same as those of the first embodiment described above.

Next, the recovery operation of the recording head 17 using the wipe unit 19 in the inkjet recording apparatus 100 in this embodiment is described. Note that the recovery operation of the recording head 17 described below is performed by controlling operations of the recording head 17, the wipe unit 19, the cleaning liquid supply pump, and the like based on the control signal from the control unit 110 (see FIG. 1).

When performing the recovery operation of the recording head 17, first as shown in FIG. 10, the control unit 110 (see FIG. 1) controls the first conveying unit 5 positioned below the recording portion 9 to move downward. Further, the control unit 110 controls the wipe unit 19 disposed below the second conveying unit 12 to move horizontally so as to be positioned between the recording portion 9 and the first conveying unit 5. In this state, the wiper 35 of the wipe unit 19 (see FIG. 27) is positioned below the ink ejection surface F1 and the lower surface F2 of the recording head 17 (see FIG. 27).

(Cleaning Liquid Supply Operation)

Figure 25:
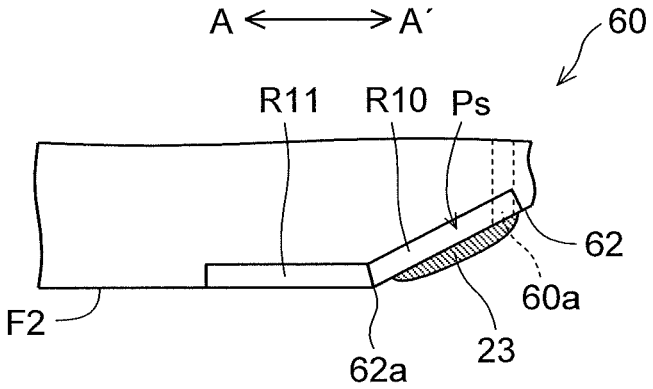
FIG. 25 is a diagram showing a state in which the cleaning liquid supplied from the cleaning liquid supply port is flowing to the downstream side in a wiping direction on the inclined surface in the inkjet recording apparatus of the second embodiment of the present disclosure.
Figure 26:
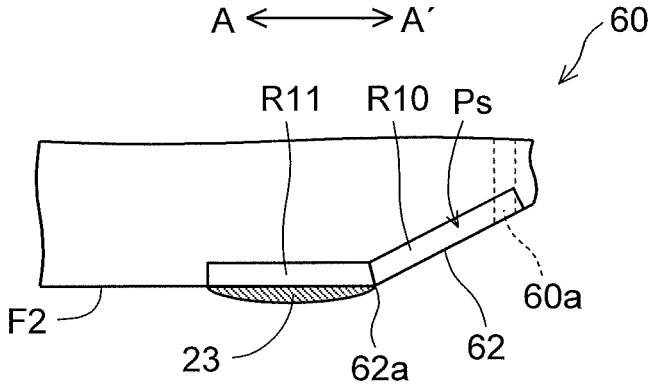
FIG. 26 is a diagram showing a state in which the cleaning liquid supplied from the cleaning liquid supply port is held by the hydrophilic region in the inkjet recording apparatus of the second embodiment of the present disclosure.

Prior to the wiping operation (wipe operation described later), the control signal from the control unit 110 (see FIG. 1) drives (turns on) the cleaning liquid supply pump (not shown), and the cleaning liquid 23 is supplied to the recording head 17. In this case, as shown in FIG. 25, the cleaning liquid 23 is supplied by a predetermined amount from the cleaning liquid supply port 60*a* to the inclined surface 62. The cleaning liquid 23 supplied to the inclined surface 62 flows on the inclined surface 62 toward the downstream side in the wiping direction (arrow A direction). Further, as shown in FIG. 26, when reaching the hydrophilic region R11 disposed in a vicinity of the downstream end 62*a*, the cleaning liquid 23 wets and spreads to the hydrophilic region R11 in the head width direction and is held in a state spreading in the substantially entire region in the head width direction on the lower surface F2. Note that, in the diagram, for easy understanding, the cleaning liquid 23 is shown with hatching.

(Ink Extrusion Operation)

Figure 27:
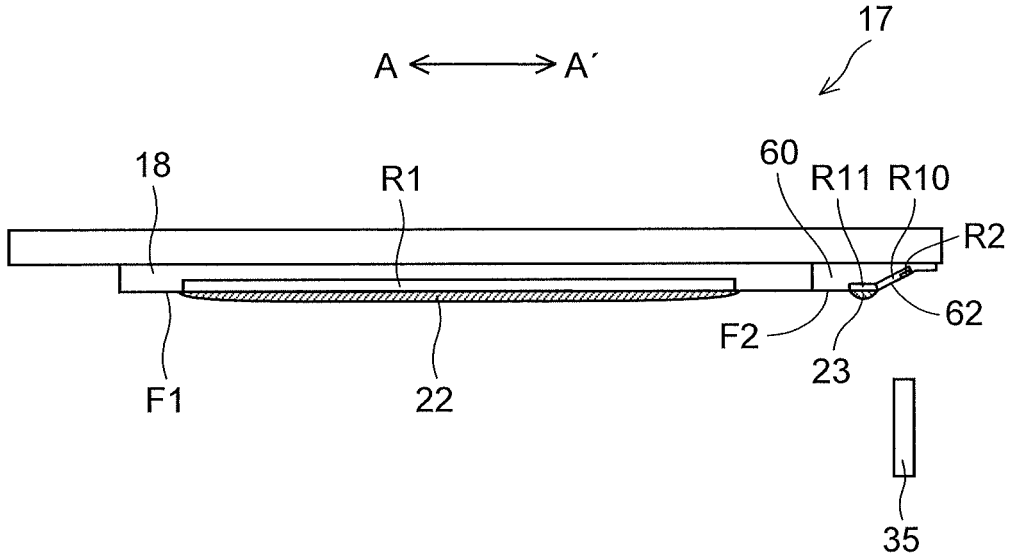
FIG. 27 is a diagram showing a state in which the wiper is positioned below the recording head in the inkjet recording apparatus of the second embodiment of the present disclosure.

In addition, prior to the wiping operation (wipe operation described later), as shown in FIG. 27, the ink 22 is supplied to the recording head 17 by the control unit 110 (see FIG. 1). The supplied ink 22 is forcibly extruded (purged) from the ink ejection port 18*a*. By this purging operation, thickened ink, foreign matters, and air bubbles in the ink ejection port 18*a* are discharged from the ink ejection port 18*a*. In this case, the purged ink 22 is extruded to the ink ejection surface F1 along a shape of the ink ejection region R1 in which the ink ejection port 18*a* exists. Note that, in the diagram, for easy understanding, the ink (purged ink) 22 is shown with hatching.

(Wipe Operation)

Figure 28:
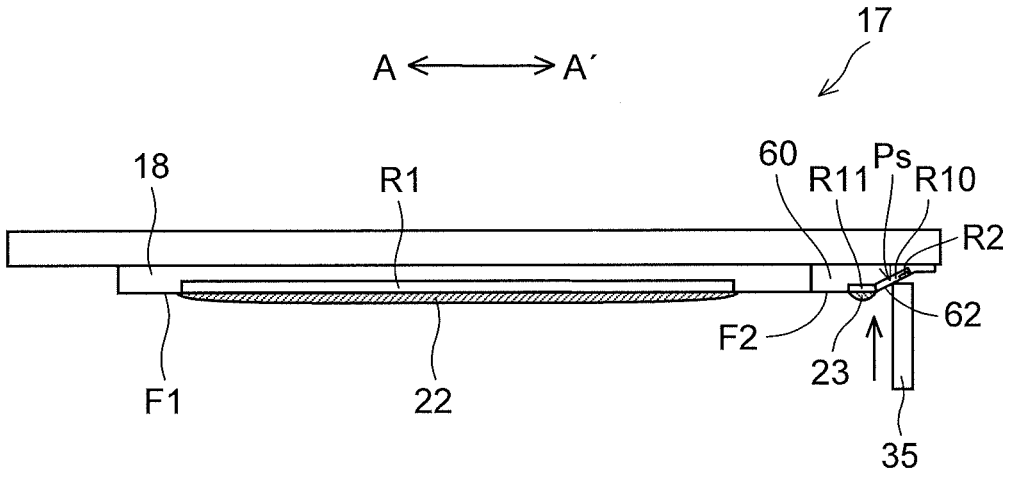
FIG. 28 is a diagram showing a state in which the wiper is moved upward from the state of FIG. 27 so as to be in pressure contact with the cleaning liquid supply member.

As shown in FIG. 28, the control unit 110 controls the wiper 35 to move upward so as to contact with the inclined surface 62 of the cleaning liquid supply member 60 of the recording head 17 by a predetermined pressure. In this case, the wiper 35 is moved upward so that the upper surface of the wiper 35 becomes higher than the ink ejection surface F1 and the lower surface F2, and lower than the cleaning liquid supply port 60*a*. In this way, the wiper 35 does not contact with the cleaning liquid supply port 60*a*. Note that at a time point when the wiper 35 is moved upward, the wiper 35 may not be in pressure contact with the inclined surface 62. In other words, the wiper 35 may be moved upward at a position shifted to the right from the position in FIG. 28.

Figure 29:
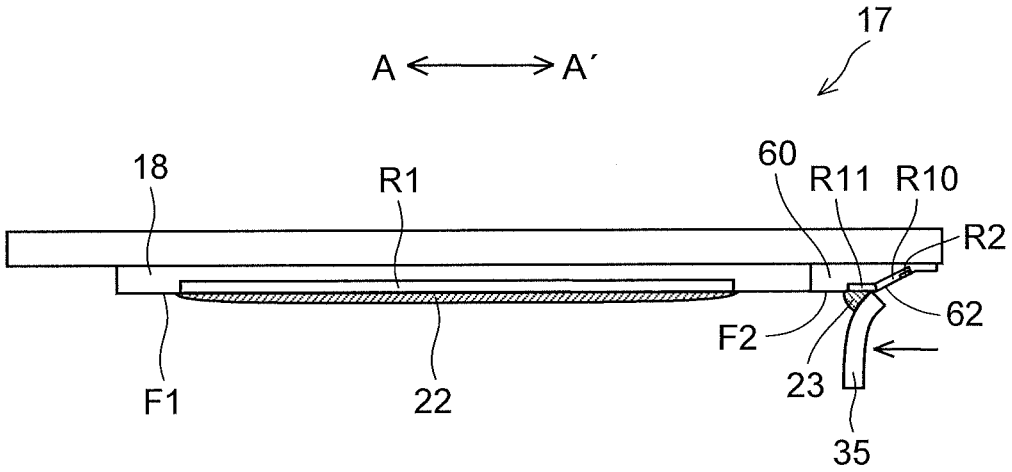
FIG. 29 is a diagram showing a state in which the wiper is moved in the arrow A direction in pressure contact with the cleaning liquid supply member from the state of FIG. 28.

In the state where the tip of the wiper 35 is in pressure contact with the inclined surface 62 of the cleaning liquid supply member 60, the control unit 110 controls the wiper 35 to move along the lower surface F2 in a direction toward the ink ejection region R1 (arrow A direction) as shown in FIG. 29. In this way, the wiper 35 moves in the direction toward the ink ejection region R1 in the state holding the cleaning liquid 23.

Figure 30:
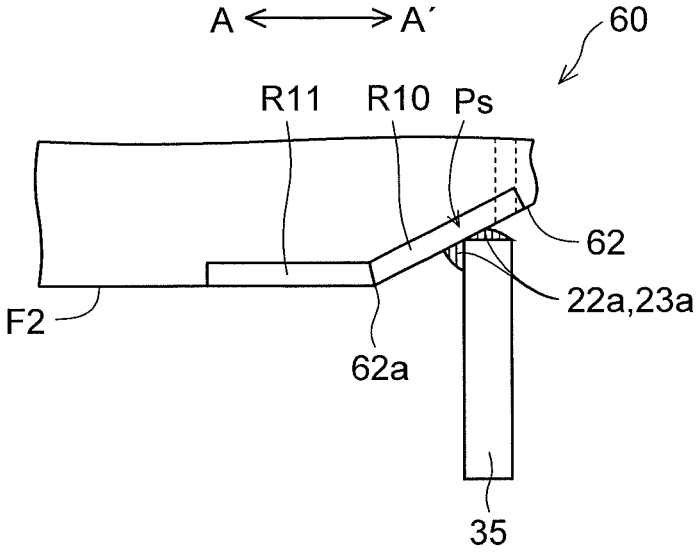
FIG. 30 is a diagram showing a state in which the wiper is made to be in pressure contact with the inclined surface in case where ink or cleaning liquid adhered to the tip portion of the wiper in the last wiping operation remains.

In this case, as shown in FIG. 30, if the ink 22*a* or the cleaning liquid 23*a* adhered to the tip portion of the wiper 35 in the last wiping operation remains, the ink 22*a* or the cleaning liquid 23*a* adhered to the tip portion of the wiper 35 is adhered (transferred) to the pressure contact start position Ps on the inclined surface 62.

In this description, as shown in FIG. 9 when the wiper 35 moves below the inclined surface 62 in the wiping direction (arrow A direction), only the corner part 35*a* of the tip of the wiper 35 contacts with the inclined surface 62. Therefore, as shown in FIG. 31, a part of the ink 22*a* or the cleaning liquid 23*a* adhered to the inclined surface 62 (part on the downstream side of the corner part 35*a* of the wiper 35 in the wiping direction) is wiped off by the wiper 35.

Figure 31:
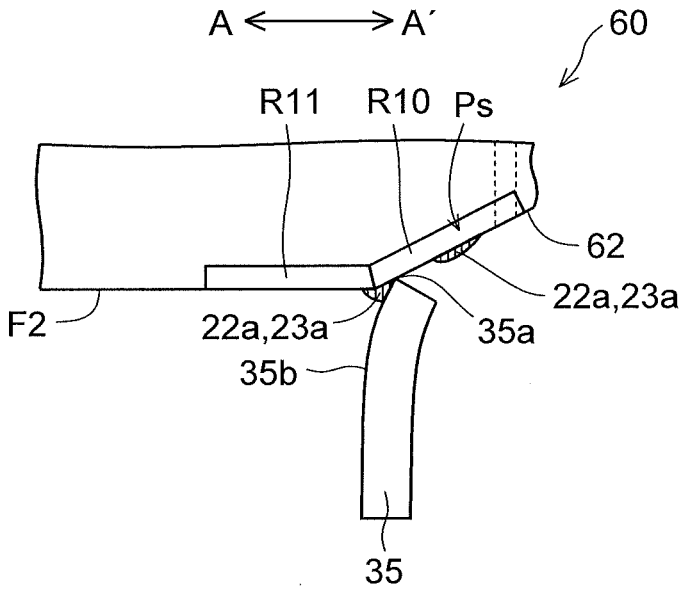
FIG. 31 is a diagram showing a state in which the wiper is moved in the arrow A direction in pressure contact with the cleaning liquid supply member from the state of FIG. 30.

In addition, the rest of the ink 22*a* or the cleaning liquid 23*a* adhered (transferred) from the tip portion of the wiper 35 to the inclined surface 62 flows in the water repellent region R10 to the downstream side in the wiping direction (arrow A direction, downward) as shown in FIG. 31.

Figure 32:
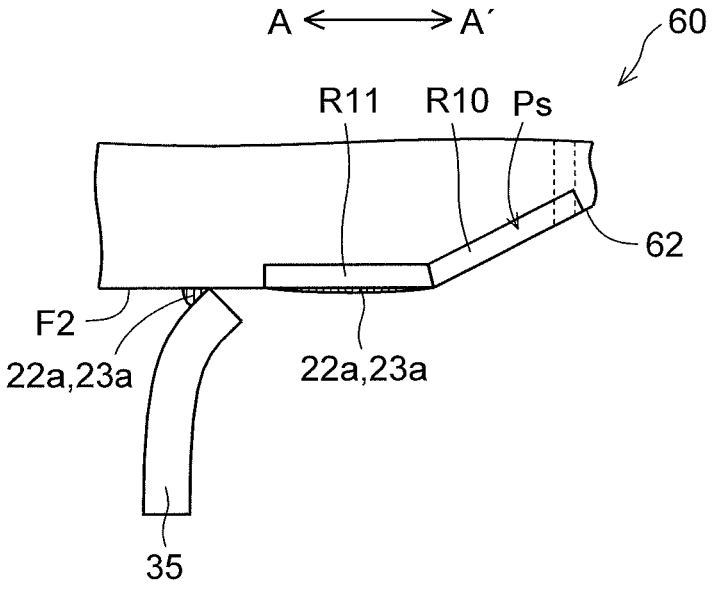
FIG. 32 is a diagram showing a state in which the wiper is further moved in the arrow A direction in pressure contact with the cleaning liquid supply member from the state of FIG. 31.

After that, the ink 22*a* or the cleaning liquid 23*a* after flowing in the water repellent region R10 reaches the hydrophilic region R11 and is held in a state wetting and spreading in the entire hydrophilic region R11 as shown in FIG. 32. The ink 22*a* or the cleaning liquid 23*a* held in the hydrophilic region R11 is wiped off by the wiper 35 in the next wiping operation.

Figure 33:
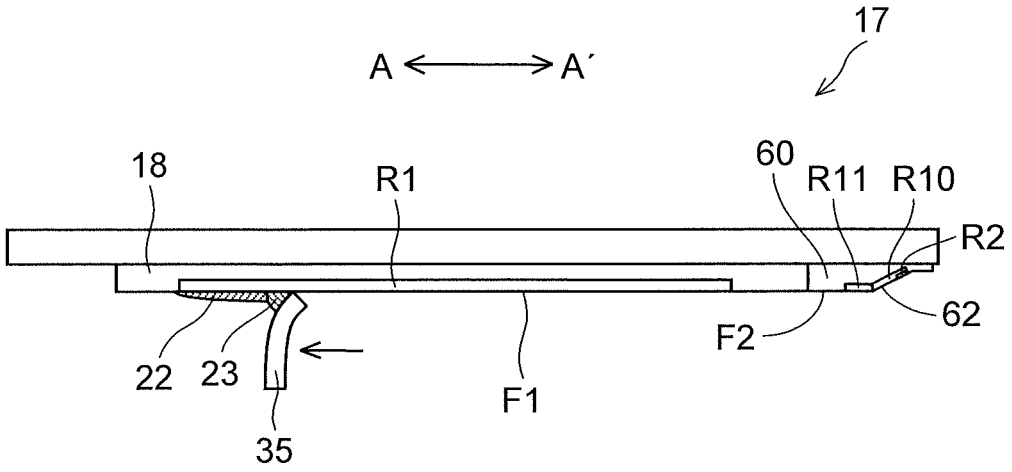
FIG. 33 is a diagram showing a state in which the wiper is further moved in the arrow A direction from the state of FIG. 29.

After the state shown in FIG. 29, the wiper 35 moves in the ink ejection surface F1 in the left direction (arrow A direction) while maintaining the state holding the cleaning liquid 23 and the purged ink 22 as shown in FIG. 33. In this case, ink droplets (waste ink) adhered to the ink ejection surface F1 and hardened are melted by the cleaning liquid 23 and the purged ink 22, and are wiped off by the wiper 35. Then, the wiper 35 further moves in the left direction (arrow A direction). When the wiper 35 reaches a position opposite to the cleaning liquid supply member 60 with respect to the ink ejection region R1, the movement in the left direction is stopped. Note that the cleaning liquid 23 and the waste ink wiped off by the wiper 35 are collected to a cleaning liquid collection tray (not shown) provided to in the wipe unit 19.

(Separation Operation)

Figure 34:
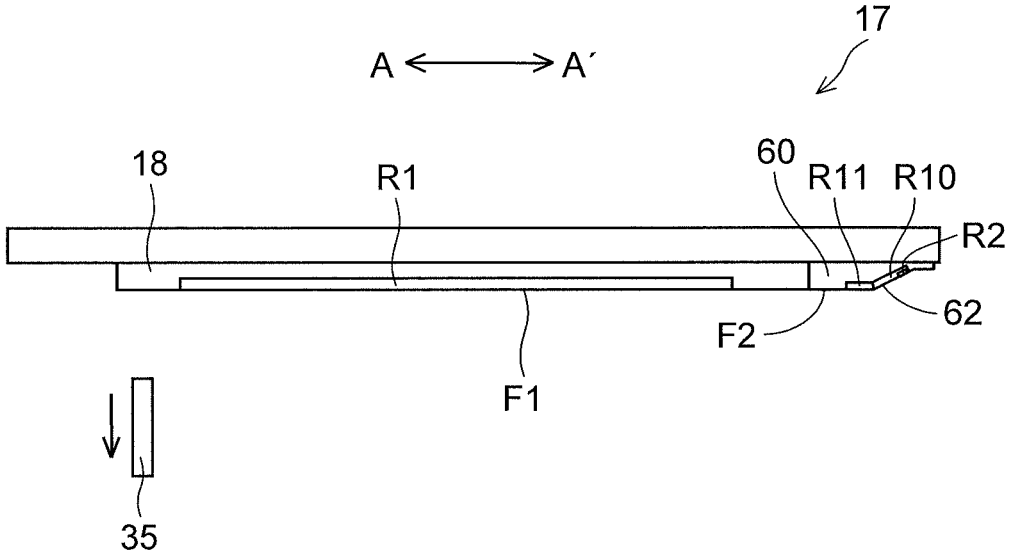
FIG. 34 is a diagram showing a state in which the wiper is further moved in the arrow A direction from the state of FIG. 33 and then is moved downward so as to separate from the ink ejection surface.

After performing the wipe operation, as shown in FIG. 34, the control unit 110 controls the wiper 35 to move downward so as to be separated from the ink ejection surface F1.

Finally, the control unit 110 controls the wipe unit 19 disposed between the recording portion 9 and the first conveying unit 5 to move horizontally to be positioned below the second conveying unit 12, and controls the first conveying unit 5 to move upward to a predetermined position. In this way, the recovery operation of the recording head 17 is finished.

In this embodiment, as described above, the recording head 17 has the inclined surface 62 that is disposed on the upstream side of the ink ejection surface F1 in the wiping direction and is inclined downward toward the downstream side in the wiping direction. The inclined surface 62 includes the plurality of cleaning liquid supply ports 60*a* for supplying the cleaning liquid 23. In this way, when the cleaning liquid 23 is supplied from the cleaning liquid supply port 60*a*, the cleaning liquid 23 flows on the inclined surface 62 toward the downstream side in the wiping direction. After the cleaning liquid 23 reaches the downstream end 62*a* of the inclined surface 62, the wiper 35 is moved from the pressure contact start position Ps of the inclined surface 62 along the ink ejection surface F1, and hence the wiper 35 can wipe the ink ejection surface F1 while holding the cleaning liquid 23. Therefore, the ink ejection surface F1 can be cleaned.

In addition, the cleaning liquid supply port 60*a* is disposed on the upstream side of the pressure contact start position Ps on the inclined surface 62 in the wiping direction. In this way, when the recovery operation of the recording head 17 is performed, the wiper 35 does not contact with an edge of the cleaning liquid supply port 60*a*. Therefore, because the tip of the wiper 35 is not rubbed against the edge of the cleaning liquid supply port 60*a*, the tip of the wiper 35 can be protected from being damaged.

In addition, by disposing the water repellent region R10 on the inclined surface 62, the cleaning liquid 23 supplied from the cleaning liquid supply port 60*a* so as to flow on the inclined surface 62 toward the downstream end 62*a* in the wiping direction can be prevented from staying at a point on the inclined surface 62.

In addition, the wiper 35 is moved upward below the inclined surface 62, and the wiper 35 is moved from the position in the wiping direction. Then, the tip portion of the wiper 35 is in pressure contact with the ink ejection surface F1 in a state being warped in the opposite direction to the wiping direction. Therefore, unlike the case where the wiper 35 is in pressure contact perpendicularly with the ink ejection surface F1, it is possible to prevent an increase in a load when the wiper 35 is in pressure contact with the ink ejection surface F1.

In addition, the inclined surface 62 is provided with the water repellent region R10, which is formed from the position P1 on the upstream side of the pressure contact start position Ps in the wiping direction to the position P2 on the downstream side and has a contact angle with water of 90° or more. In this way, the ink 22*a* or the cleaning liquid 23*a* adhered (transferred) to the inclined surface 62 from the wiper 35 in the wiping operation flows on the inclined surface 62 to the position P2 on the downstream side of the pressure contact start position Ps in the wiping direction. The ink 22*a* or the cleaning liquid 23*a* flowing on the inclined surface 62 is wiped off by the wiper 35 in the next wiping operation. Therefore, the ink 22*a* or the cleaning liquid 23*a* on the surface of the recording head 17 is prevented from gradually increasing, and hence it is possible to prevent the ink 22*a* or the cleaning liquid 23*a* from contacting the paper sheet S and adhering to the paper sheet S, or from dropping to the paper sheet S or the conveying unit of the paper sheet S.

In addition, as described above, the water repellent region R10 is formed from the position P1 on the upstream side of the cleaning liquid supply port 60*a* in the wiping direction to the position P2 on the downstream side of the pressure contact start position Ps in the wiping direction. In this way, the cleaning liquid 23 supplied from the cleaning liquid supply port 60*a* can easily flow to the position P2 on the downstream side of the pressure contact start position Ps in the wiping direction.

In addition, as described above, the water repellent region R10 is formed from the position P1 on the upstream side of the pressure contact start position Ps in the wiping direction to the downstream end 62*a* of the inclined surface 62. In this way, the cleaning liquid 23 supplied from the cleaning liquid supply port 60*a* so as to flow on the inclined surface 62 can easily flow to the downstream end 62*a* of the inclined surface 62.

In addition, as described above, the water repellent region R10 is formed in the substantially entire region in the head width direction on the inclined surface 62. In this way, the ink 22*a* or the cleaning liquid 23*a* adhered to the both ends of the inclined surface 62 in the head width direction from the wiper 35 in the wiping operation can also flow to the downstream side in the wiping direction.

In addition, as described above, the downstream side of the water repellent region R10 in the wiping direction in a vicinity of the downstream end 62*a* of the inclined surface 62 is provided with the hydrophilic region R11 having a contact angle with water less than 90° formed to extend in the head width direction. In this way, the cleaning liquid 23 supplied from the cleaning liquid supply port 60*a* so as to flow to the downstream end 62*a* of the inclined surface 62 wets and spreads to the hydrophilic region R11 in the head width direction. Therefore, the time after the wiper 35 starts to wipe the cleaning liquid 23 until the cleaning liquid 23 spreads to the entire region in the head width direction of the recording head 17 can be decreased, and hence it is possible to prevent occurrence of an unwiped portion on both ends in the head width direction of the ink ejection surface F1.

In addition, because the cleaning liquid 23 supplied from the cleaning liquid supply port 60*a* spreads along the hydrophilic region R11 and is held, it is possible to prevent the cleaning liquid 23 from gathering in the middle part in the head width direction (arrow BB' direction) to be large droplets and dropping from the cleaning liquid supply member 60. In this way, loss of the cleaning liquid 23 can be reduced.

In addition, the ink 22*a* or the cleaning liquid 23*a* adhered (transferred) to the inclined surface 62 from the wiper 35 in the wiping operation so as to flow to the downstream end 62*a* of the inclined surface 62 wets and spreads to the hydrophilic region R11, and hence the ink 22*a* or the cleaning liquid 23*a* can be prevented from hanging down. Therefore, the ink 22*a* or the cleaning liquid 23*a* is more prevented from contacting and adhering to the paper sheet S.

In addition, the ink 22*a* or the cleaning liquid 23*a* adhered to the inclined surface 62 from the wiper 35 in the wiping operation spreads along the hydrophilic region R11 and is held, the ink 22*a* or the cleaning liquid 23*a* can be prevented from gathering in the middle part in the head width direction (arrow BB' direction) to be large droplets and dropping from the cleaning liquid supply member 60.

In addition, as described above, the hydrophilic region R11 is formed in the substantially entire region in the head width direction in a vicinity of the downstream end 62*a*. In this way, the time after the wiper 35 starts to wipe the cleaning liquid 23 until the cleaning liquid 23 spreads to the entire region in the head width direction of the recording head 17 can be decreased, and hence it is possible to easily prevent occurrence of an unwiped portion on both ends in the head width direction of the ink ejection surface F1.

In addition, because the hydrophilic region R11 is formed in the substantially entire region in the head width direction in a vicinity of the downstream end 62*a*, the ink 22*a* or the cleaning liquid 23*a* adhered (transferred) to the inclined surface 62 from the wiper 35 in the wiping operation so as to flow on both ends in the head width direction of the inclined surface 62 can also reach the hydrophilic region R11 securely.

In addition, as described above, the inclination angle $\alpha 1$ of the inclined surface 62 with respect to the ink ejection surface F1 is smaller than the pressure contact angle $\alpha 2$ of the tip portion of the wiper 35 with respect to the ink ejection surface F1 in the state where the wiper 35 is wiping the ink ejection surface F1. In this way, when the wiper 35 moves in the wiping direction in pressure contact with the inclined surface 62 of the recording head 17, the wiper 35 is not warped more than or equal to the pressure contact angle $\alpha 2$ with respect to the ink ejection surface F1, and hence the wiper 35 moves while only the corner part 35*a* contacts with the inclined surface 62. In other words, the side surface 35*b* of the wiper 35 does not contact with the side surface (inclined surface 62) of the recording head 17. Therefore, the cleaning liquid 23, the ink 22*a*, and the cleaning liquid 23*a* can be prevented from remaining on the inclined surface 62.

In addition, as described above, the inclination angle $\alpha 1$ is 15° or more and less than 45°. In this way, the cleaning liquid 23, the ink 22*a*, and the cleaning liquid 23*a* can easily flow toward the downstream end 62*a* of the inclined surface 62, and only the corner part 35*a* of the tip of the wiper 35 can easily contact with the inclined surface 62.

Other effects of the second embodiment are the same as those of the first embodiment described above.

Note that the embodiments disclosed in this description are merely examples in every aspect and should not be interpreted as limitations. The scope of the present disclosure is defined not by the above description of the embodiments but by claims and should be understood to include all modifications within meanings and scopes equivalent to the claims.

Figure 35:
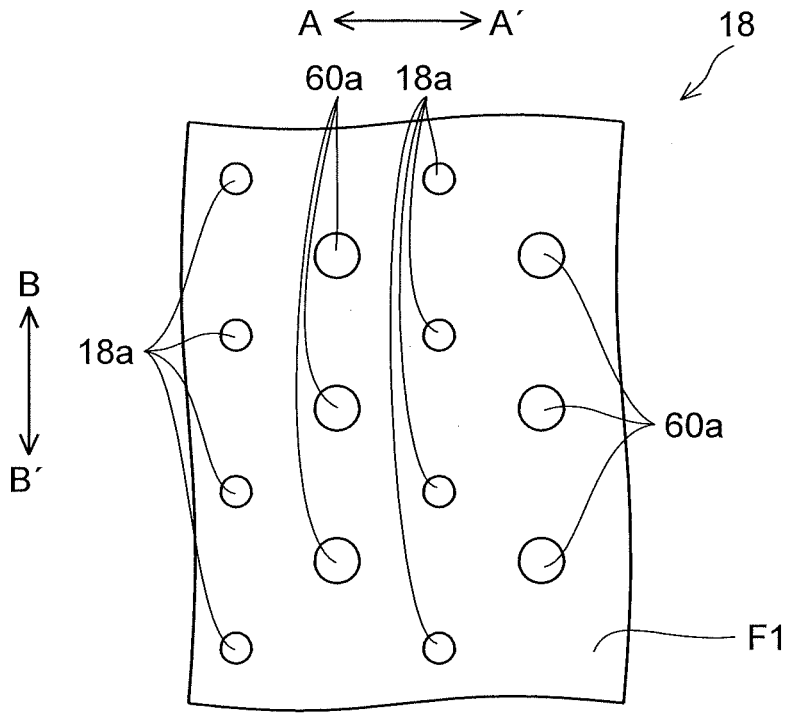
FIG. 35 is a diagram of the head portion of the recording head of a variation of the first embodiment of the present disclosure viewed from below.

For example, the first embodiment describes the example in which the cleaning liquid supply member 60 in which the cleaning liquid supply port 60*a* is formed is disposed as a body separate from the head portion 18, but the present disclosure is not limited to this. Without disposing the cleaning liquid supply member 60, the cleaning liquid supply port 60*a* may be formed on the ink ejection surface (supply port formation surface) F1 of the head portion 18. In this case, like the recording head 17 of a variation of the first embodiment of the present disclosure shown in FIG. 35, for example, the cleaning liquid supply port 60*a* may be disposed adjacent to the ink ejection port 18*a* (e.g. the ink ejection ports 18*a* and the cleaning liquid supply ports 60*a* may be arranged in an alternating manner).

In addition, the first embodiment describes the example in which the length in the head width direction L35 of the wiper 35 is formed to be smaller than the length L60 of the cleaning liquid supply surface F2 and the inclined surface 62 in the head width direction, but the length in the head width direction L35 of the wiper 35 may be formed to be larger than the length L60 of the cleaning liquid supply surface F2 and the inclined surface 62 in the head width direction.

In addition, the second embodiment describes the example in which the cleaning liquid supply member 60 provided with the inclined surface 62 and the cleaning liquid supply port 60*a* is disposed as a body separate from the head portion 18, but the present disclosure is not limited to this. Without disposing the cleaning liquid supply member 60, the inclined surface 62 and the cleaning liquid supply port 60*a* may be formed in the head portion 18.

Figure 36:
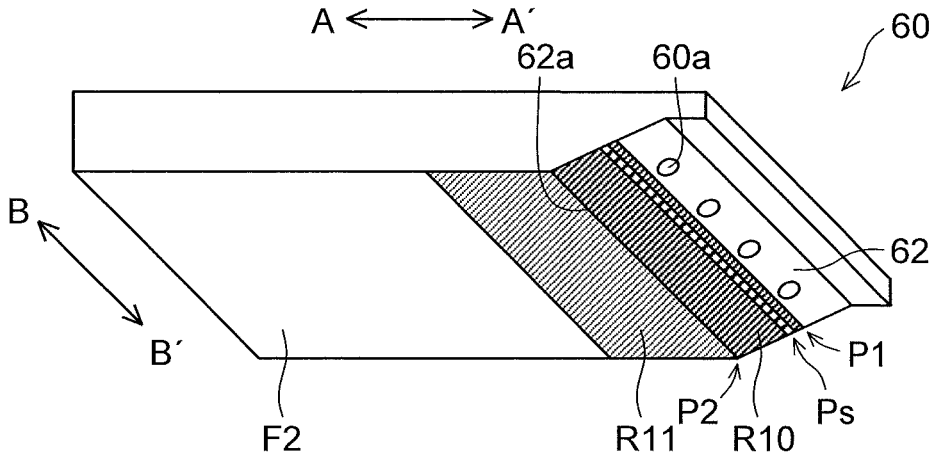
FIG. 36 is a diagram of the cleaning liquid supply member of the recording head of a first variation of the second embodiment of the present disclosure viewed from obliquely below.
Figure 37:
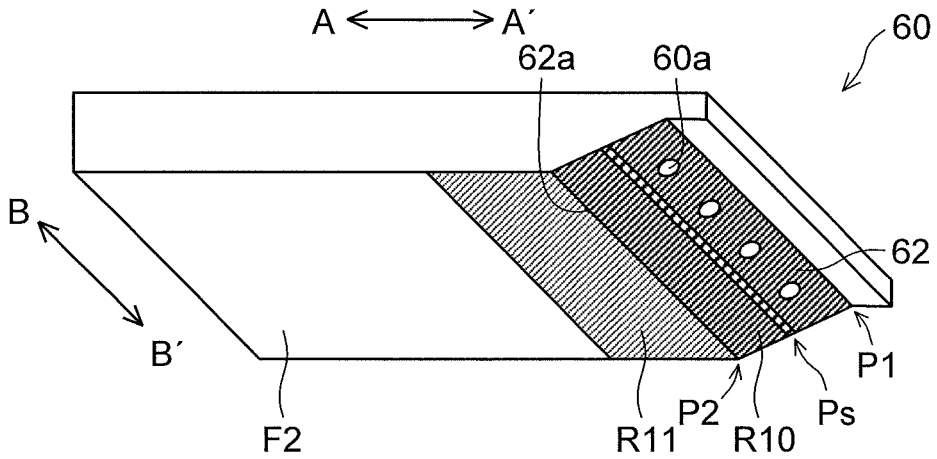
FIG. 37 is a diagram of the cleaning liquid supply member of the recording head of a second variation of the second embodiment of the present disclosure viewed from obliquely below.

In addition, the second embodiment describes the example in which the water repellent region R10 is disposed from the position P1 on the upstream side of the cleaning liquid supply port 60*a* in the wiping direction toward the downstream side in the wiping direction, but the present disclosure is not limited to this. For example, like a first variation of the second embodiment of the present disclosure shown in FIG. 36, the water repellent region R10 may be disposed from the position P1 that is on the downstream side of the cleaning liquid supply port 60*a* in the wiping direction and is on the upstream side of the pressure contact start position Ps in the wiping direction toward the downstream side in the wiping direction. In addition, like a second variation of the second embodiment of the present disclosure shown in FIG. 37, for example, the water repellent region R10 may be disposed in the entire region of the inclined surface 62.

In addition, the second embodiment describes the example in which the hydrophilic region R11 is formed in a strip shape continuous over substantially the entire region in the head width direction in a vicinity of the downstream end 62*a*, but the present disclosure is not limited to this. For example, a plurality of the hydrophilic regions R11 may be disposed independently (separately) in the head width direction. With this structure, the cleaning liquid 23, the ink 22*a* and the cleaning liquid 23*a* can be easily prevented from gathering in the middle part in the head width direction (arrow BB' direction). In addition, a plurality of the hydrophilic regions R11 may be disposed adjacent to each other in the wiping direction. In addition, the hydrophilic region R11 may be formed in a shape other than the rectangular shape (strip shape).

In addition, the embodiment describes the example in which the cleaning liquid 23 and the ink (purged ink) 22 are used for performing the recovery operation of the recording head 17, but only the cleaning liquid 23 may be used for performing the recovery operation of the recording head 17. In other words, the ink extrusion operation may not be performed.

In addition, appropriate combinations of the structures of the embodiments and variations described above are also included in the technical scope of the present disclosure.

What is claimed is:

1. A head cleaning mechanism comprising:

a recording head having an ink ejection surface in which a plurality of ink ejection ports are opened to eject ink onto the recording medium; and a wiper for wiping the ink ejection surface in a predetermined direction, wherein the recording head includes a plurality of cleaning liquid supply ports disposed on an upstream side of the ink ejection port in a wiping direction in which the wiper wipes the ink ejection surface, so as to supply cleaning liquid, and an inclined surface connected to a supply port formation surface in which the cleaning liquid supply ports are formed, on the upstream side in the wiping direction, the inclined surface being inclined downward toward a downstream side in the wiping direction, a tip of the wiper being in pressure contact with the inclined surface in the wiping operation, and the inclined surface has a pressure contact start position at which the wiper starts the pressure contact in the wiping operation, and a water repellent region formed at least from the pressure contact start position to a position on an upstream side of the cleaning liquid supply port in the wiping direction to have a contact angle with water of 90° or more.

2. The head cleaning mechanism according to claim 1, wherein a hydrophilic region having a contact angle with water of less than 90° is disposed to extend in a head width direction perpendicular to the wiping direction in a vicinity of a connecting part between the supply port formation surface and the inclined surface, on the downstream side of the water repellent region in the wiping direction.

3. The head cleaning mechanism according to claim 2, wherein the hydrophilic region is formed in the substantially entire region in the head width direction in a vicinity of the connecting part.

4. The head cleaning mechanism according to claim 2, wherein the hydrophilic region is formed on the supply port formation surface, and the water repellent region is formed at least from the pressure contact start position to the connecting part on the inclined surface.

5. The head cleaning mechanism according to claim 4, wherein a contact angle with water of the hydrophilic region is smaller than a contact angle with water of the supply port formation surface.

6. The head cleaning mechanism according to claim 1, wherein the water repellent region is formed in the substantially entire region in a head width direction perpendicular to the wiping direction on the inclined surface.

7. The head cleaning mechanism according to claim 1, wherein the recording head is constituted of an ink ejection head portion having the ink ejection surface, and a cleaning liquid supplying head portion having the inclined surface and a cleaning liquid supply surface as the supply port formation surface including a cleaning liquid supply region in which the plurality of cleaning liquid supply ports are opened.

8. The head cleaning mechanism according to claim 7, wherein a length in the head width direction perpendicular to the wiping direction of the wiper is larger than a length in the head width direction of the ink ejection surface and is smaller than a length in the head width direction of the inclined surface, and a length in the head width direction of the water repellent region is larger than the length in the head width direction of the wiper.

9. The head cleaning mechanism according to claim 1, wherein an inclination angle of the inclined surface with respect to the ink ejection surface is smaller than a pressure contact angle of the tip portion of the wiper with respect to the ink ejection surface in a state where the wiper is wiping the ink ejection surface.

10. The head cleaning mechanism according to claim 9, wherein the inclination angle is 15° or more and less than 45°.

11. An inkjet recording apparatus comprising the head cleaning mechanism according to claim 1.

12. A head cleaning mechanism comprising:

a recording head having an ink ejection surface provided with an ink ejection region in which a plurality of ink ejection ports are opened to eject ink onto the recording medium; and a wiper for wiping the ink ejection surface in a predetermined direction, wherein the recording head includes an inclined surface disposed on an upstream side of the ink ejection surface in a wiping direction in which the wiper wipes the ink ejection surface, the inclined surface being inclined downward toward a downstream side in the wiping direction, a tip of the wiper being in pressure contact with the inclined surface in the wiping operation, and the inclined surface includes a plurality of cleaning liquid supply ports for supplying cleaning liquid disposed on the upstream side in the wiping direction of the pressure contact start position at which the wiper starts the pressure contact in the wiping operation, and a water repellent region formed from a position on the upstream side of the pressure contact start position in the wiping direction to a position on the downstream side, so as to have a contact angle with water of 90° or more.

13. The head cleaning mechanism according to claim 12, wherein the water repellent region is formed at least from the cleaning liquid supply port to the position on the downstream side in the wiping direction.

14. The head cleaning mechanism according to claim 12, wherein the water repellent region is formed from the position on the upstream side to a downstream end of the inclined surface in the wiping direction.

15. The head cleaning mechanism according to claim 12, wherein the water repellent region is formed in the substantially entire region in the head width direction perpendicular to the wiping direction on the inclined surface.

16. The head cleaning mechanism according to claim 12, wherein a hydrophilic region having a contact angle with water of less than 90° is disposed to extend in a head width direction perpendicular to the wiping direction in a vicinity of a downstream end of the inclined surface in the wiping direction, on the downstream side of the water repellent region in the wiping direction.

17. The head cleaning mechanism according to claim 16, wherein the hydrophilic region is formed in the substantially entire region in the head width direction in a vicinity of the downstream end.

18. The head cleaning mechanism according to claim 12, wherein the recording head is constituted of an ink ejection head portion having the ink ejection surface, and a cleaning liquid supplying head portion having the inclined surface, and a lower surface extending from the downstream end of the inclined surface in the wiping direction toward the ink ejection surface.

19. The head cleaning mechanism according to claim 12, wherein an inclination angle of the inclined surface with respect to the ink ejection surface is smaller than a pressure contact angle of the tip portion of the wiper with respect to the ink ejection surface in a state where the wiper is wiping the ink ejection surface.

20. An inkjet recording apparatus comprising the head cleaning mechanism according to claim 12.

* * * * *